US006921873B2

(12) United States Patent
Puskar et al.

(10) Patent No.: US 6,921,873 B2
(45) Date of Patent: Jul. 26, 2005

(54) CIRCUIT BREAKER TRIP UNIT EMPLOYING A ROTARY PLUNGER

(75) Inventors: Michael P. Puskar, Carnegie, PA (US); Thomas A. Whitaker, North Huntingdon, PA (US); William M. Randal, Baldwin Township, PA (US)

(73) Assignee: Eaton Corporation, Cleveland, OH (US)

( * ) Notice: Subject to any disclaimer, the term of this patent is extended or adjusted under 35 U.S.C. 154(b) by 74 days.

(21) Appl. No.: 10/633,007

(22) Filed: Aug. 1, 2003

(65) Prior Publication Data

US 2005/0023120 A1 Feb. 3, 2005

(51) Int. Cl.[7] ..... H01H 1/52; H01H 3/20; H01H 9/00

(52) U.S. Cl. ..... 200/321; 200/400; 200/401; 335/167; 335/176; 335/23

(58) Field of Search ..... 200/321, 323, 200/400, 401; 335/23–25, 167–176

(56) References Cited

U.S. PATENT DOCUMENTS 4,401,872 A * 8/1983 Boichot-Castagne et al. .... 200/401
4,468,533 A * 8/1984 Kodera et al. ..... 200/400
4,642,430 A * 2/1987 Tedesco ..... 200/401
4,713,508 A * 12/1987 Baginski et al. ..... 200/568
5,428,495 A 6/1995 Murphy et al.
5,910,760 A 6/1999 Malingowski et al.
6,137,386 A 10/2000 Mueller
6,144,271 A 11/2000 Mueller et al.
6,167,329 A 12/2000 Engel et al.
6,225,883 B1 5/2001 Wellner et al.
6,437,261 B1 * 8/2002 Bryant et al. ..... 200/43.16
6,448,522 B1 * 9/2002 Rosen et al. ..... 200/400

* cited by examiner

*Primary Examiner*—K. Lee
(74) *Attorney, Agent, or Firm*—Martin J. Moran

(57) ABSTRACT

A circuit breaker trip unit includes a housing and a rotary plunger pivotally mounted within the housing. The rotary plunger has an on position and a tripped position. A portion of the rotary plunger is pivoted outside of the housing in the tripped position. A trip bar is pivotally mounted within the housing and includes a first tab latching the rotary plunger in the first position and releasing the rotary plunger from the first position. The trip bar also includes a second tab. A trip actuator includes a solenoid and a rotary trip lever engaging the second tab of the trip bar, in order to pivot the trip bar and release the rotary plunger from the on position. A spring biases the trip bar, in order that the first tab latches the rotary plunger in the on position. A pair of springs biases the rotary plunger to the tripped position.

6 Claims, 17 Drawing Sheets

CIRCUIT BREAKER TRIP UNIT EMPLOYING A ROTARY PLUNGER

CROSS-REFERENCE TO RELATED APPLICATIONS

This application is related to commonly assigned, concurrently filed:

U.S. patent application Ser. No. 10/633,006, filed Aug. 1, 2003, entitled "Circuit Breaker Trip Unit Employing A Reset Overtravel Compensating Rotary Trip Lever"; and U.S. patent application Ser. No. 10/633,009, filed Aug. 1, 2003, entitled "Circuit Breaker Trip Unit Including a Plunger Resetting a Trip Actuator Mechanism and a Trip Bar".

BACKGROUND OF THE INVENTION

1. Field of the Invention

This invention relates to electrical switching apparatus and, more particularly, to circuit breakers employing a trip unit. The invention also relates to circuit breaker trip units.

2. Background Information

Circuit breakers and circuit breaker trip units are well known in the art. See, for example, U.S. Pat. Nos. 5,910,760; and 6,144,271.

Resetting of a circuit breaker (e.g., through the operating handle and operating mechanism thereof) is accomplished in a manner well known in the art and is described and shown, for example, in U.S. Pat. No. 5,910,760.

Industrial circuit breakers often use a modular component called a trip unit. The modular trip unit can be replaced by the customer to alter the electrical properties of the circuit breaker. The trip unit includes a linear plunger, which operates the circuit breaker's operating mechanism and frequently protrudes from the trip unit. See, for example, U.S. Pat. No. 6,144,271, which discloses a circuit breaker frame and internals, and a trip unit.

As disclosed in U.S. Pat. No. 6,144,271, the linear plunger of the trip unit is employed to trip open the associated circuit breaker frame whenever the linear plunger is extended from the trip unit. Actuation of primary and secondary frame latches occurs exclusively by way of the extended and resetable trip unit linear plunger, which is, otherwise, normally contained entirely within the trip unit. The secondary frame latch is in disposition to be struck by an abutment surface of the extended linear plunger. In response to a reset operation, the trip unit is also reset whenever the secondary frame latch drives the extended linear plunger in the opposite direction against its plunger spring and into the trip unit.

The linear travel of the linear plunger often impedes the installation and removal of the trip unit. If the plunger is extended, then awkward assembly and breakage can occur. Also, the linear travel distance of the linear plunger and/or the required travel distance of such linear plunger to cause a trip may be affected by manufacturing tolerances in the trip unit and/or in the circuit breaker frame. Thus, in some circumstances, insufficient travel of the linear plunger may result in no tripping of the circuit breaker.

During a high current interruption, an explosion in the arc chamber of the circuit breaker is the result of rapidly expanding gases. During this explosion, fragments of various circuit breaker components form debris that is expelled throughout the breaker. This debris can become lodged into critical mechanism parts, such as the trip unit linear plunger, causing them to malfunction.

There is a need for an improved circuit breaker employing a trip unit.

There is also a need for an improved circuit breaker trip unit.

SUMMARY OF THE INVENTION

These needs and others are satisfied by the present invention which provides a trip unit employing a rotary plunger. Not only does this permit more travel but, in the event of an interference between the rotary plunger and the circuit breaker frame, the rotary plunger is simply rotated out of the way by a built in cam action. Furthermore, the rotary plunger provides a second function, which operates the circuit breaker while, also, clearing debris out of its way with a sweeping action.

As an aspect of the invention, a trip unit comprises: a housing; a rotary plunger pivotally mounted with respect to the housing, the rotary plunger having a first position and a second position, a portion of the rotary plunger being pivoted outside of the housing in the second position; means for latching the rotary plunger in the first position and for releasing the rotary plunger from the first position; and means for biasing the rotary plunger to the second position.

The means for latching the rotary plunger in the first position and for releasing the rotary plunger from the first position may include a trip bar pivotally mounted within the housing. The rotary plunger may include a latch surface within the housing. The trip bar may include a tab engaging the latch surface of the rotary plunger, in order to latch the rotary plunger in the first position. The tab of the trip bar may be a first tab and the trip bar may include a second tab. The means for latching the rotary plunger in the first position and for releasing the rotary plunger from the first position may further include a rotary trip lever pivotally mounted within the housing, with the rotary trip lever engaging the second tab of the trip bar, in order to rotate the trip bar and disengage the first tab from the latch surface of the rotary plunger, in order to release the rotary plunger from the first position.

The rotary plunger may include a first pivot engaging the housing. The means for biasing the rotary plunger to the second position may include a second pivot engaging the rotary plunger at a position offset from the first pivot, a member engaging the housing at a position offset from the first pivot, and at least one spring disposed between the second pivot and the member. Each of the second pivot and the member may include a first end and a second end. The at least one spring may be a first spring engaging the first ends of the second pivot and the member, and a second spring engaging the second ends of the second pivot and the member.

The portion of the rotary plunger being pivoted outside of the housing in the second position may include a surface adapted to engage a latch of a circuit breaker frame. The portion of the rotary plunger being pivoted outside of the housing in the second position may be generally pie-slice shaped and may include a first sub-portion having a first radius and a second sub-portion having a smaller second radius, with the first sub-portion being adapted to engage a latch of a circuit breaker frame.

As another aspect of the invention, a trip unit comprises: a housing; a rotary plunger pivotally mounted with respect to the housing, the rotary plunger having a first position and a second position, a portion of the rotary plunger being pivoted outside of the housing in the second position; a trip bar pivotally mounted with respect to the housing, the trip bar including a first tab latching the rotary plunger in the first position and releasing the rotary plunger from the first position, the trip bar also including a second tab; a trip actuator including a member engaging the second tab of the trip bar, in order to pivot the trip bar and release the rotary plunger from the first position; means for biasing the trip bar, in order that the first tab latches the rotary plunger in the first position; and means for biasing the rotary plunger to the second position.

The rotary plunger may include a first pivot engaging the housing. The means for biasing the rotary plunger to the second position may include a member engaging the housing at a position offset from the first pivot, a second pivot engaging the rotary plunger at a position offset from the first pivot, a first spring and a second spring, with the member and the second pivot including a first end and a second end, with the first spring engaging the first ends of the second pivot and the member, and with the second spring engaging the second ends of the second pivot and the member.

As another aspect of the invention, a circuit breaker comprises: a circuit breaker frame comprising: a housing, a line terminal, a load end terminal, separable contacts electrically connected between the line terminal and the load end terminal, an operating mechanism moving the separable contacts between a closed position and an open position, and a latch mechanism latching the operating mechanism to provide the closed position of the separable contacts and releasing the operating mechanism to provide the open position of the separable contacts; and a trip unit comprising: a housing, a line end terminal electrically connected to the load end terminal of the circuit breaker frame, a rotary plunger pivotally mounted to the housing of the trip unit, the rotary plunger having a first position and a second position, a portion of the rotary plunger being pivoted outside of the housing of the trip unit in the second position, means for latching the rotary plunger in the first position and for releasing the rotary plunger from the first position, and means for biasing the rotary plunger to the second position.

The rotary plunger may have a reset position, which resets the means for latching the rotary plunger in the first position. The portion of the rotary plunger may be pivoted inside of the housing of the trip unit in the reset position.

The housing of the trip unit may include a surface adjacent to the circuit breaker frame. The trip unit may be adapted for disengagement from the circuit breaker frame. The means for latching the rotary plunger in the first position may latch the rotary plunger about flush with the surface of the housing of the trip unit. The housing of the circuit breaker frame may include a surface. The rotary plunger may include a surface, which is pivoted outside of the housing of the trip unit in the second position. When the trip unit is disengaged from the circuit breaker frame, the surface of the circuit breaker frame may cam the surface of the rotary plunger to pivot the rotary plunger to be about flush with the surface of the housing of the trip unit.

The housing of the trip unit may include an opening for the rotary plunger. The opening of the housing of the trip unit may include debris after a trip of the circuit breaker frame. When the portion of the rotary plunger is pivoted outside of the housing of the trip unit, the rotary plunger may sweep the debris out of the opening of the housing of the trip unit.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
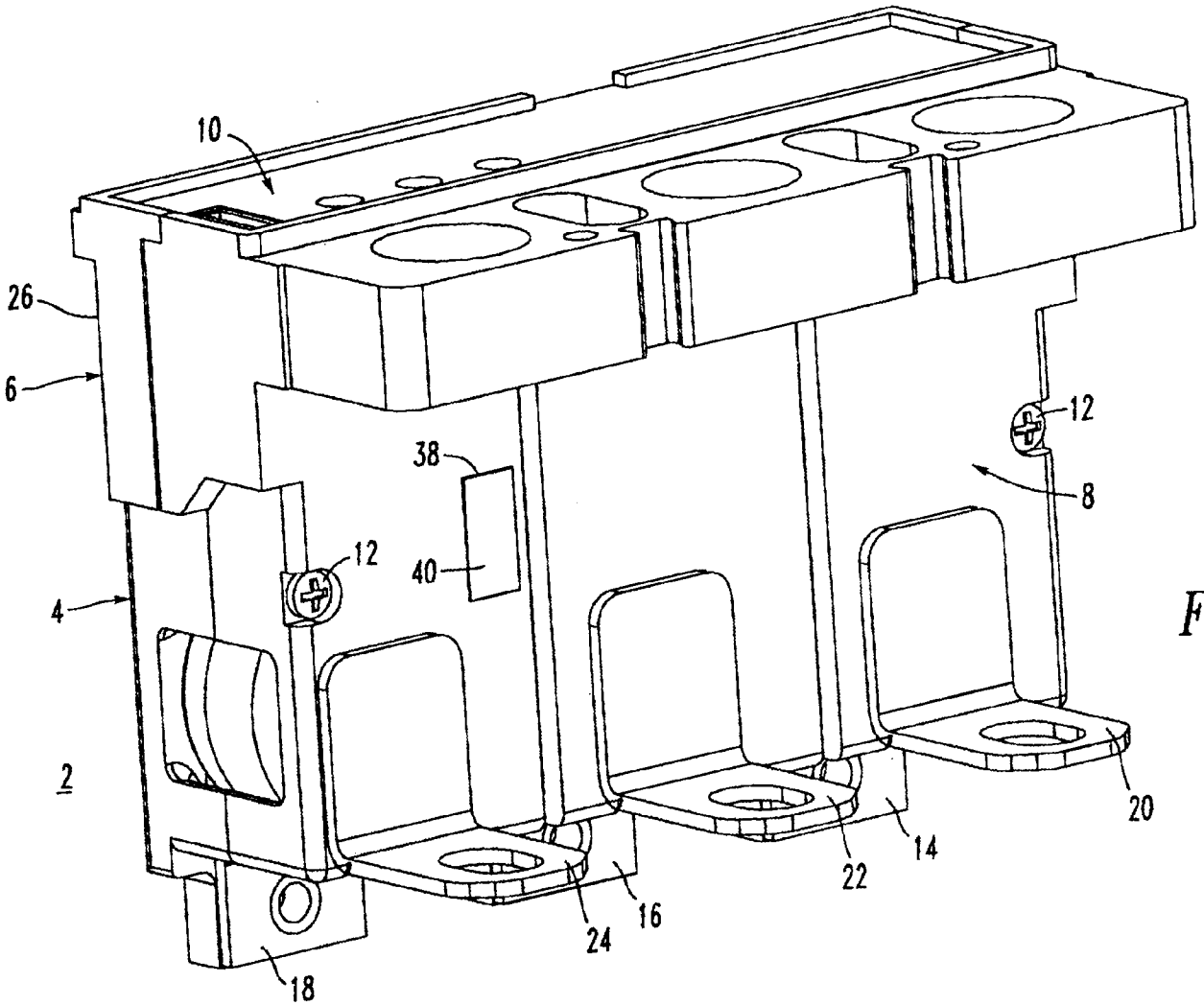
FIG. 1 is a front isometric view of a trip unit in accordance with the present invention.
Figure 2:
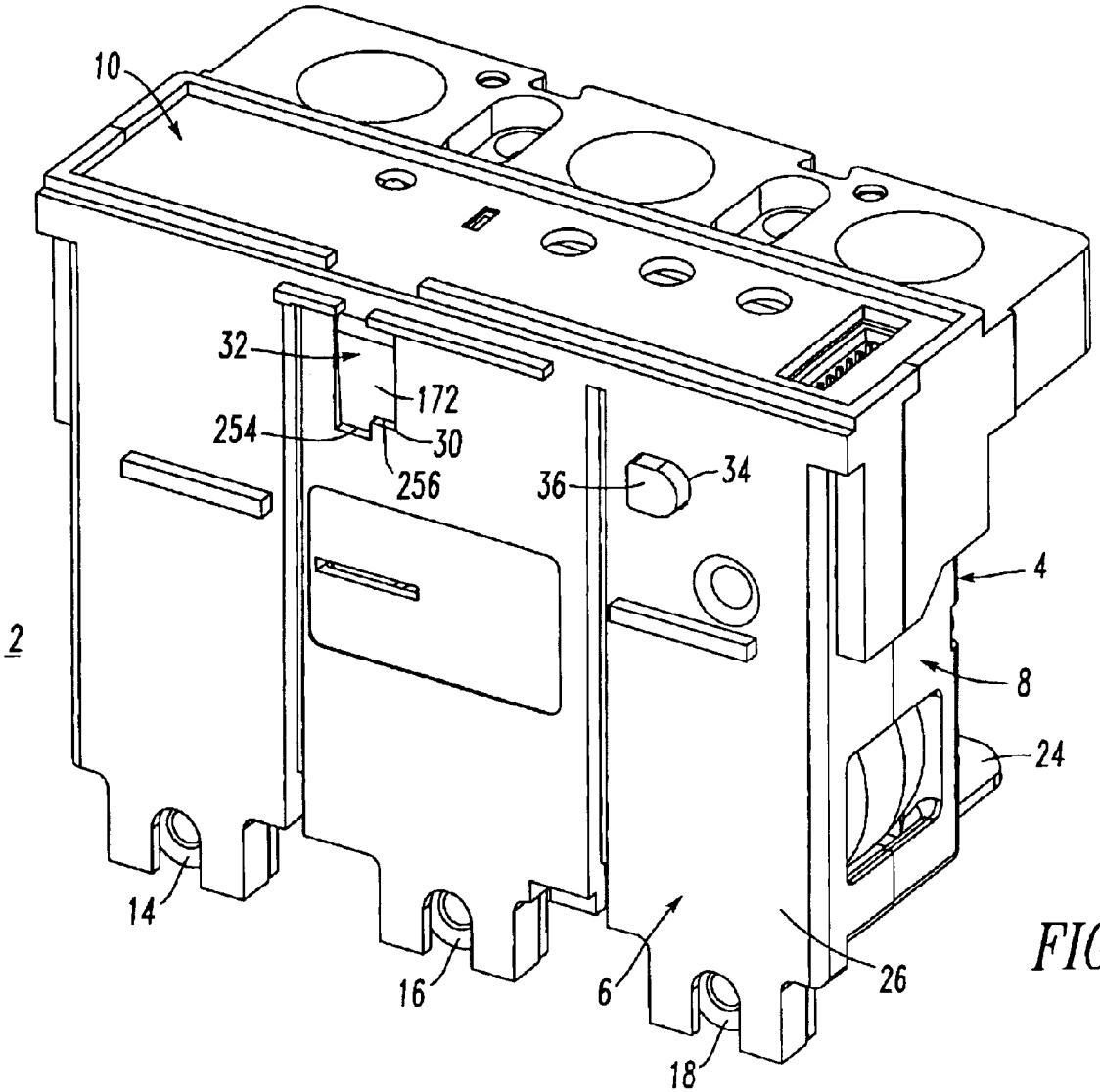
FIG. 2 is a rear isometric view of the trip unit of FIG. 1.

Referring to FIGS. 1 and 2, a trip unit 2 is shown. The trip unit 2 includes a molded housing 4 having a base 6, a cover 8 and a top portion 10. A pair of screws 12 secures the cover 8 to the base 6. Disposed from the base 6 are three-phase line end terminals 14,16,18. The cover 8 includes corresponding load end terminals 20,22,24, respectively.

Figure 3:
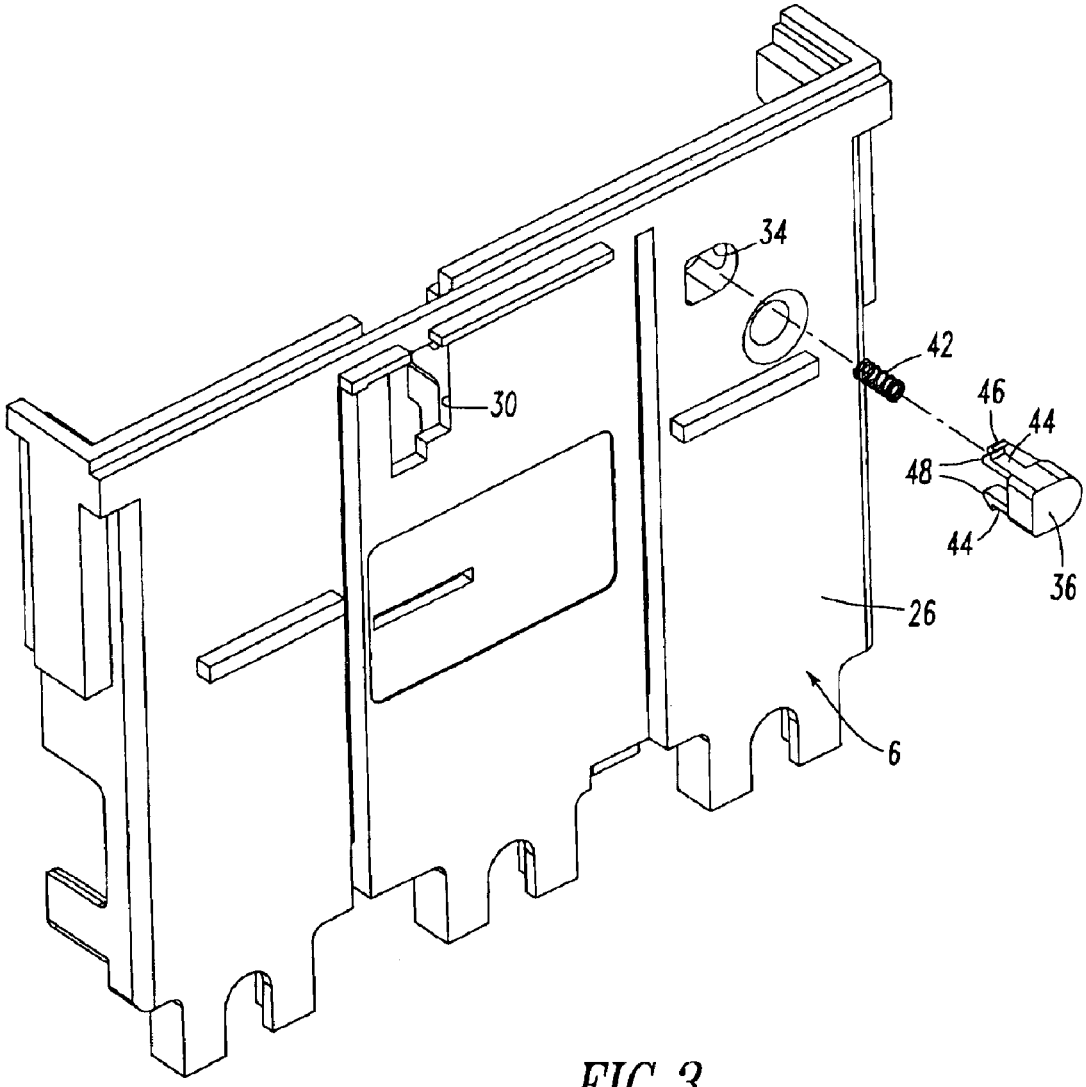
FIG. 3 is an exploded rear isometric view of the base and attachment button of FIG. 2 along with a spring therefor.
Figure 10:
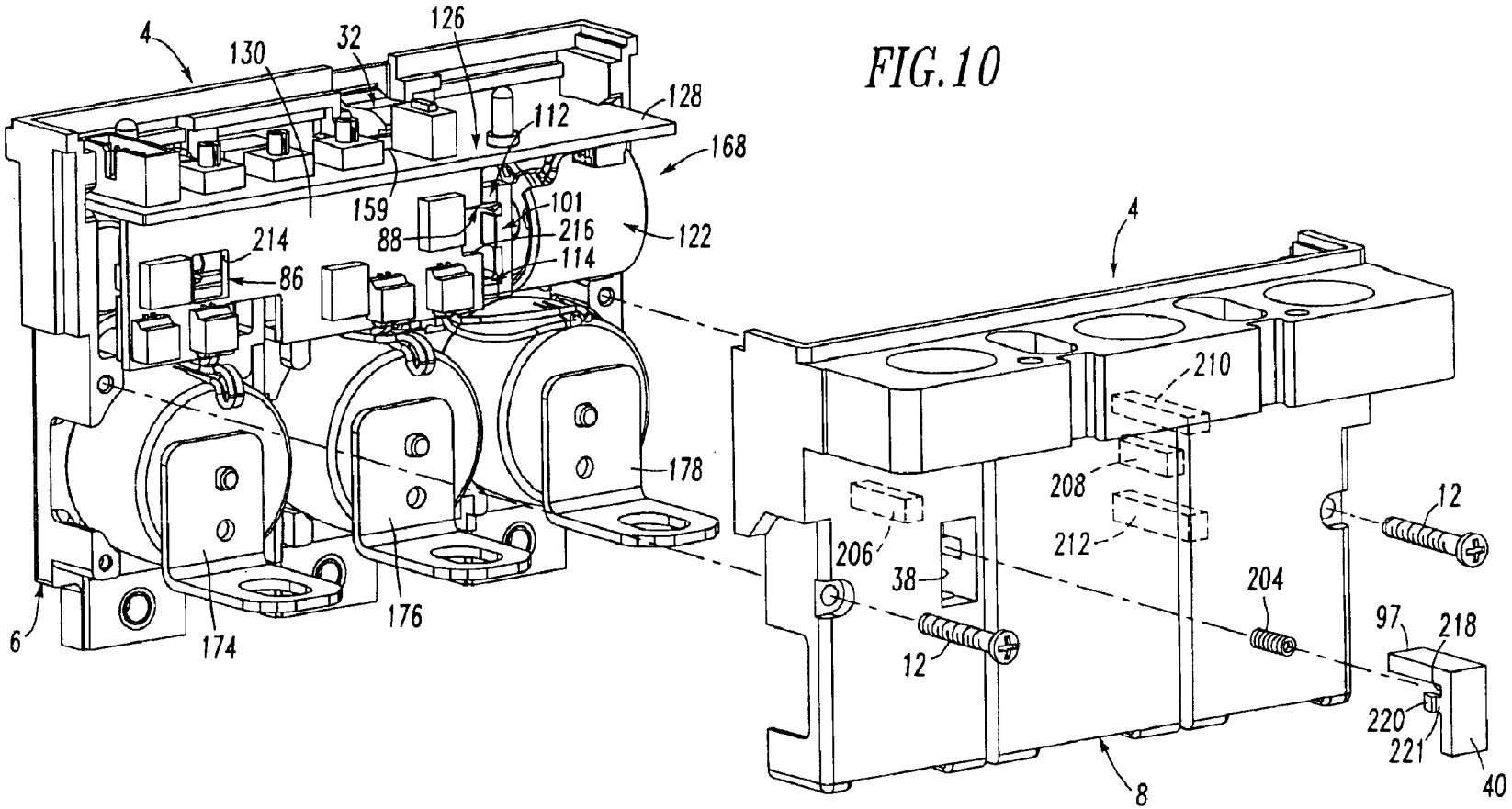
FIG. 10 is an exploded rear isometric view of the assembly of the cover on the assembled base of FIG. 9 along with the earth leakage button and spring therefor.
Figure 11:
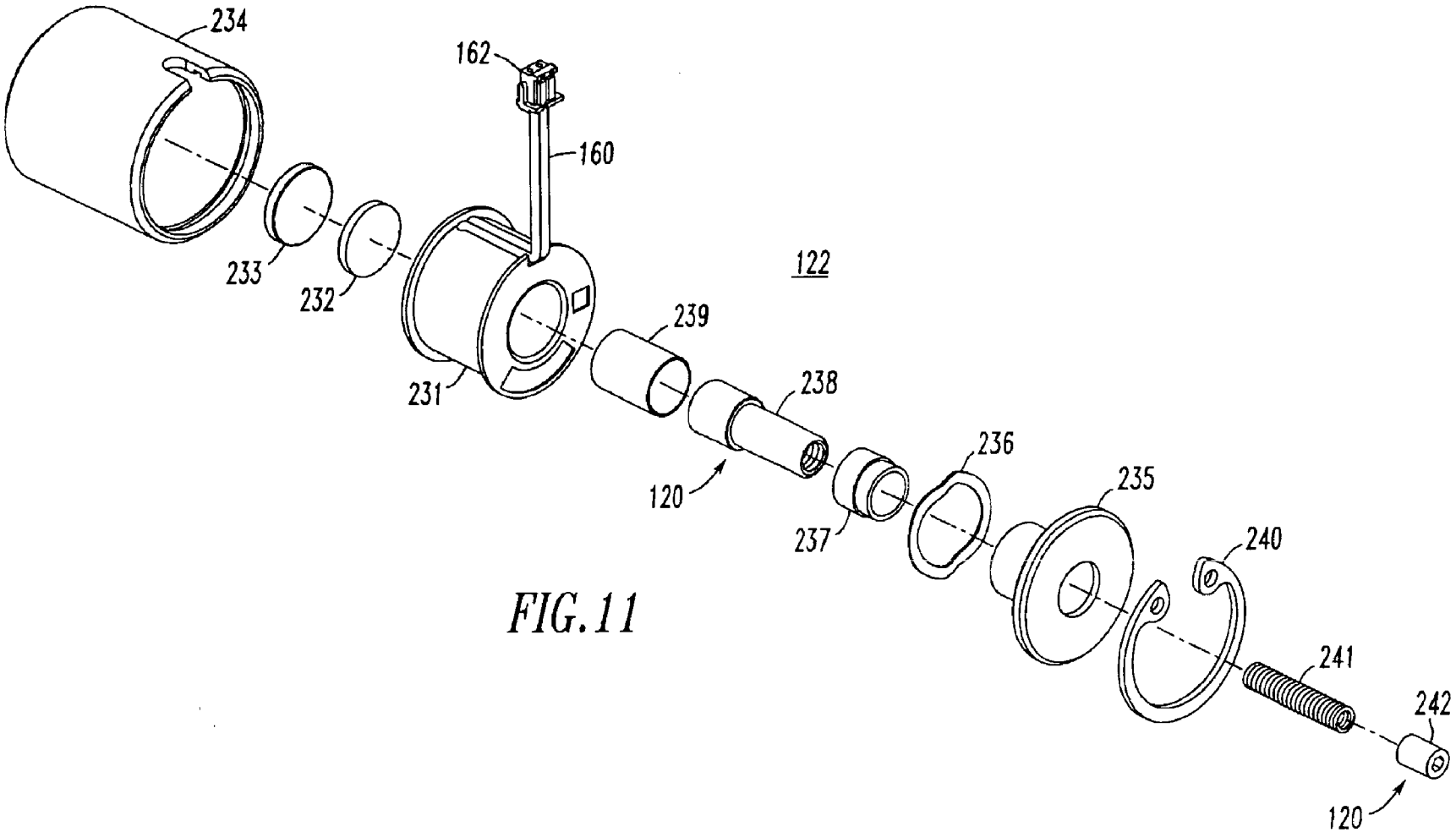
FIG. 11 is an exploded isometric view of the trip actuator of FIG. 8.
Figure 15:
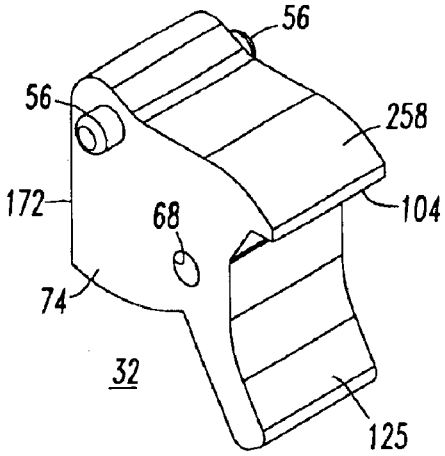
FIG. 15 is an isometric view of the rotary plunger of FIG. 2.
Figure 20:
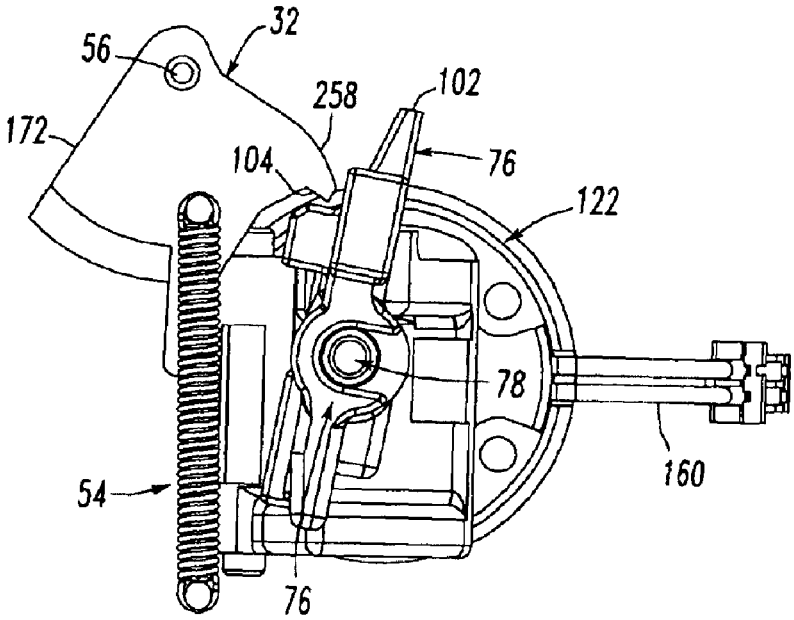
Figure 21:
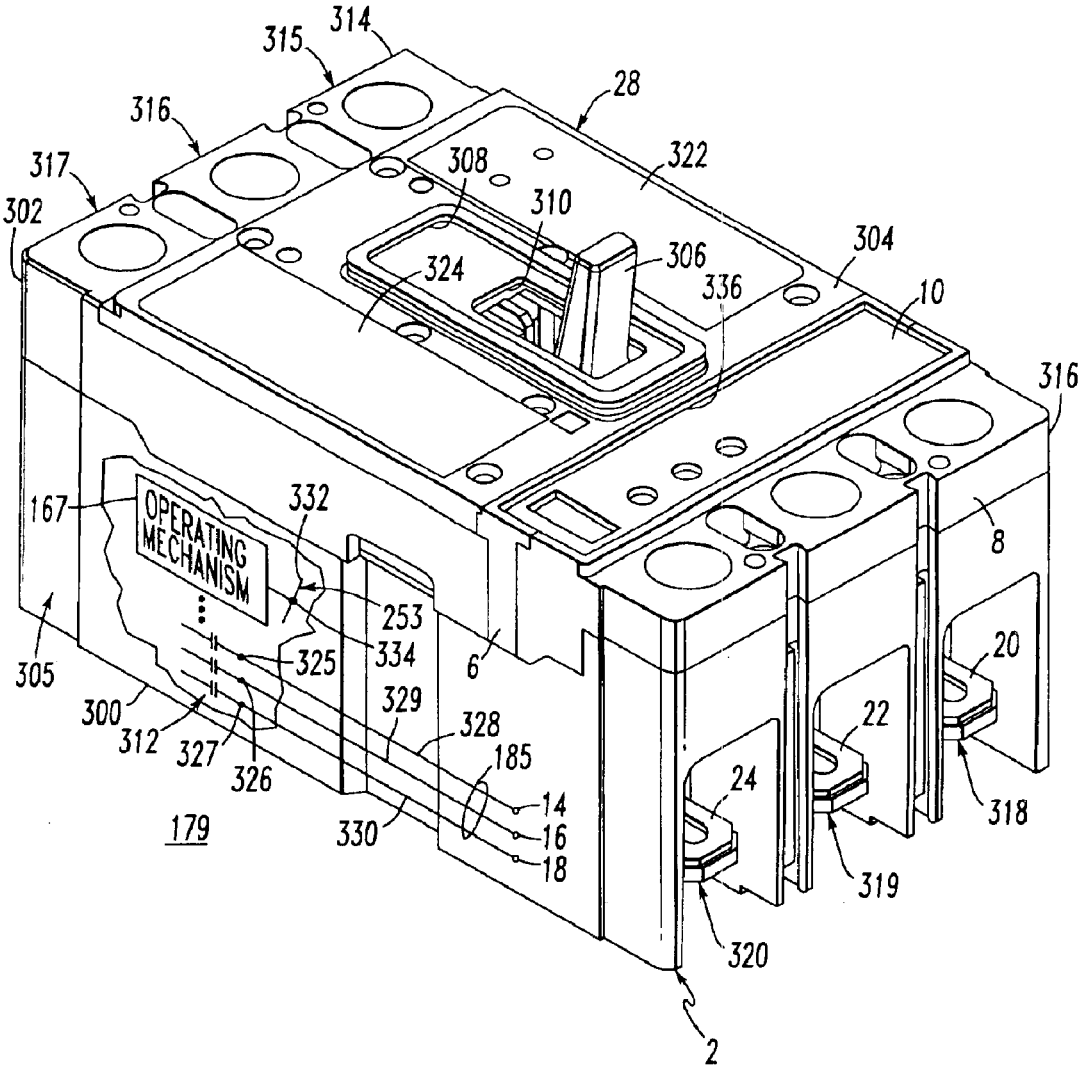
FIG. 21 is an isometric view of a circuit breaker including the trip unit of FIG. 1.

The base 6 includes a surface 26 (as shown in FIG. 2), which is disposed adjacent to a circuit breaker frame 28 as shown in FIG. 21. The trip unit 2 is advantageously adapted for engagement within and disengagement from the circuit breaker frame 28. The base surface 26 includes an opening 30 for a plunger, such as a rotary plunger 32 (as best shown in FIG. 15), and an opening 34 for an attachment button 36 (as best shown in FIG. 3). As discussed below in connection with FIGS. 4 and 18–20, the rotary plunger 32 is pivotally mounted with respect to the housing 4 and includes a first or on position (FIG. 18), a second or tripped position (FIG. 20) and a third or reset position (FIGS. 1 and 19A–19B). The on position is substantially flush with the base surface 26, the tripped position is extended from the surface 26, and the reset position is pivoted within the opening 30 and recessed behind the surface 26. The cover 8 includes an opening 38 for receiving an earth leakage button 40 (as best shown in FIG. 10).

Figure 5:
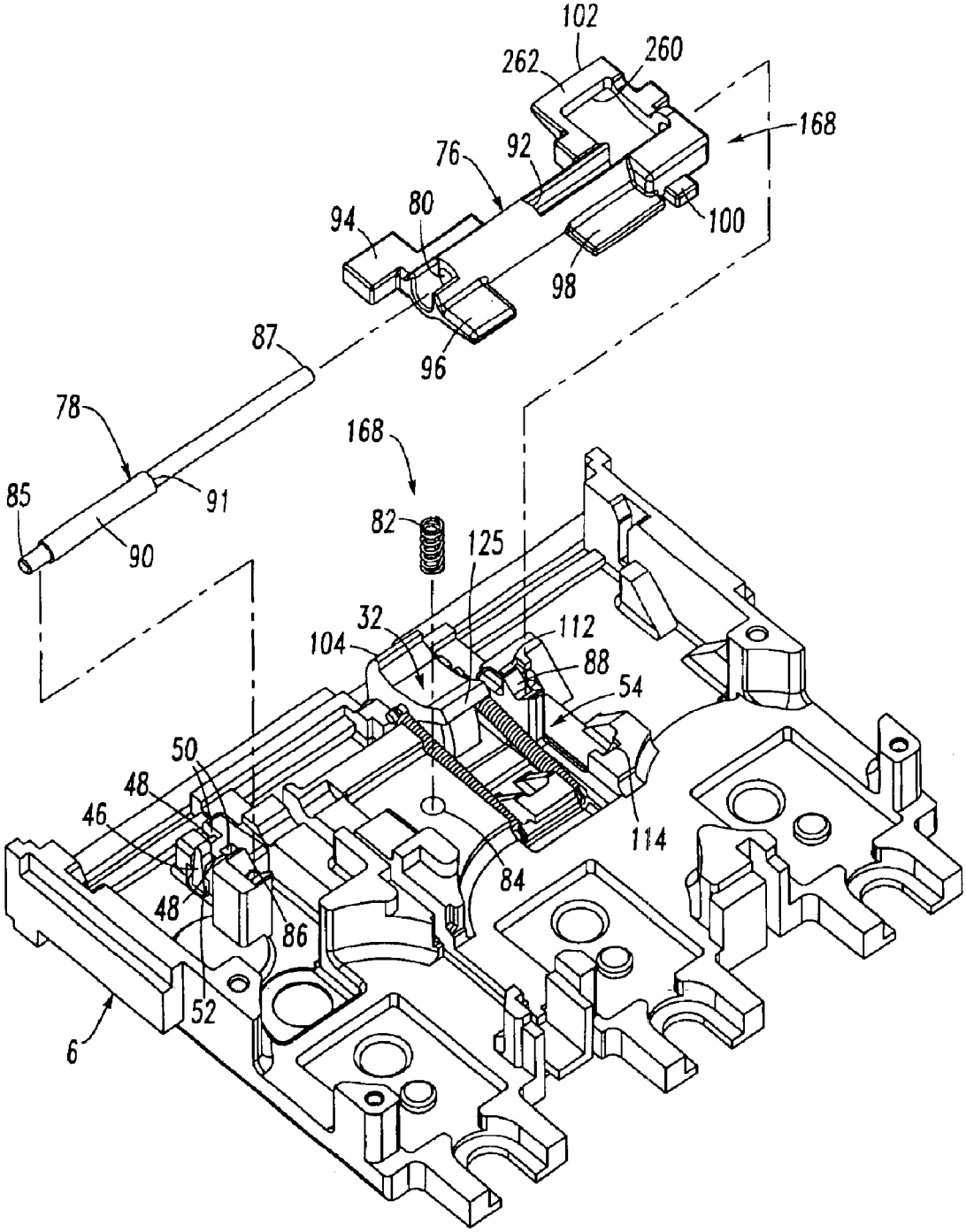
FIG. 5 is a front isometric view of the assembly of FIG. 4 with the trip bar, trip bar pivot member and trip bar spring being exploded from the base to show the assembly thereof.

Referring to FIGS. 3 and 5, the attachment button 36 is biased away from the surface 26 of the base 6 by a spring 42. The attachment button 36 includes a pair of legs 44 and a plunger 46 (shown in FIG. 5). The legs 44 have opposing feet 48, which extend in opposite directions (up and down with respect to FIG. 3), and which protrude through and are captured by openings 50 in the base 6 of FIG. 5. The attachment button plunger 46 protrudes through an opening 52 of the base 6. The spring 42 is disposed between the button legs 44 and engages a surface (not shown) of the base 6 between the openings 50.

Figure 4:
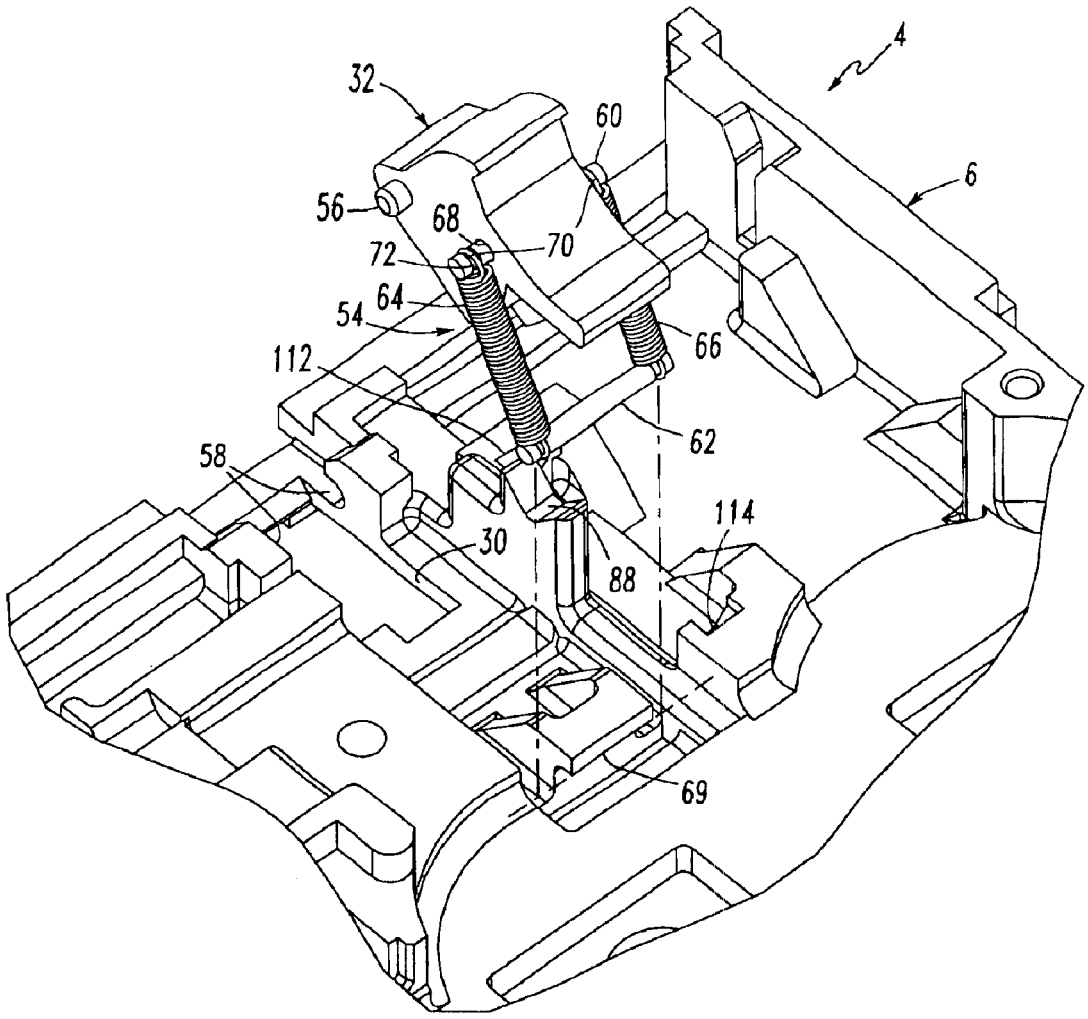
FIG. 4 is an exploded front isometric view of the base and rotary plunger of FIG. 2 along with the spring bias mechanism therefor.

Referring now to FIGS. 4 and 15, FIG. 4 shows the assembly of a spring bias mechanism 54 and the rotary plunger 32 (as best shown in FIG. 15) at the opening 30 of the base 6. The rotary plunger 32 includes a pair of pivot posts 56, which pivotally mount the rotary plunger at a corresponding pair of pivot recesses 58 proximate the opening 30 in the housing base 6.

The spring mechanism 54 includes two bar members 60,62 and two springs 64,66. The first bar member 60 pivotally engages the rotary plunger 32 at an opening 68, the position of which is offset from the pivot posts 56 of the rotary plunger. The second bar member 62, in turn, engages a pivot recess 69 in the housing base 6 at a position offset from the pivot recesses 58 and at the opposite end of the opening 30. As shown in FIG. 4, the two springs 64,66 suitably engage the opposite ends of the two bar members 60,62. For example, as best shown with the first bar member 60 and the first spring 64, the ends of the springs 64,66 have loops 70, which are captured by recesses 72 in the corresponding ends of the bar members 60,62. The springs 64,66, thus, bias the rotary plunger 32, in order that the two bar members 60,62 are in about the same plane, which is parallel to the base surface 26 of FIG. 3, when the rotary plunger is in the extended or tripped position of FIG. 20. This causes a portion 74 (as best shown in phantom line drawing in FIG. 22) of the rotary plunger 32 to be biased outside of the base 6 in that tripped position. Although two springs 64,66 are shown, the invention is applicable to spring mechanisms employing one (not shown) or more springs, which suitably bias a rotary plunger.

Figure 16:
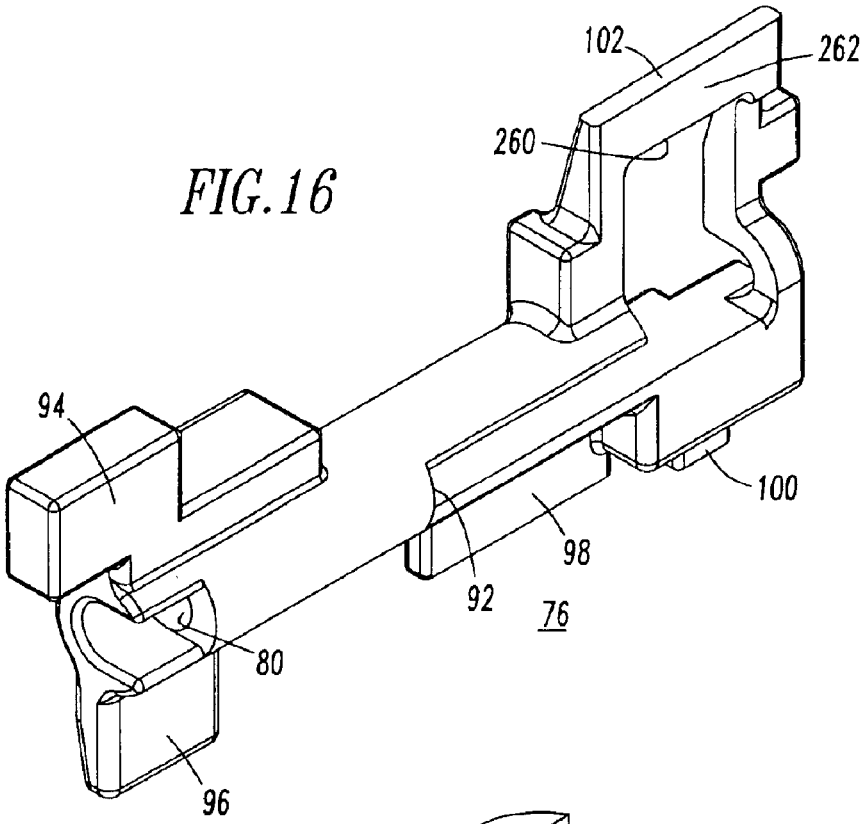
FIG. 16 is an isometric view of the trip bar of FIG. 5.

Referring to FIG. 5, the assembly from FIG. 4 of the base 6, the spring mechanism 54 and the rotary plunger 32 is shown, with the rotary plunger being held in the on position of FIG. 18 by a trip bar 76 (as best shown in FIG. 16) as will be explained below. The trip bar 76 is shown exploded for ease of illustration, although it will be appreciated that the trip bar holds the rotary plunger 32 in its on position. A trip bar pivot member 78 passes through a longitudinal opening 80 in the trip bar 76. A trip bar spring 82 rests in an opening 84 of the housing base 6. A first end 85 of the pivot member 78 rests in a first pivot point 86, and an opposite second end 87 of the member 78 rests in a second pivot point 88 of the base 6. The pivot member 78 preferably includes a portion 90 with a shoulder 91, which engages a portion 92 of the trip bar 76 where the opening 80 narrows. This precludes the member 78 from passing all the way through the longitudinal opening 80 (toward the top right of FIG. 5). The trip bar 76 is, thus, pivotally mounted with respect to and within the housing 4 and functions, as will be discussed in greater detail below, to latch the rotary plunger 32 in the on position (FIG. 18), to release the rotary plunger 32 from such on position to the tripped position (FIG. 20), and to cooperate with the rotary plunger 32 to re-latch it in the on position after the reset position (FIGS. 19A–19B).

Figure 22:
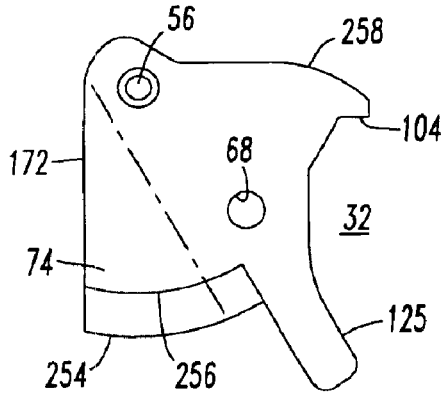
FIG. 22 is a plan view of the rotary plunger of FIG. 15.

The example trip bar 76 includes: (1) a tab 94 for the plunger 46 of the attachment button 36 of FIGS. 3 and 5; (2) a tab 96 for a plunger 97 of the earth leakage button 40 of FIG. 10; (3) a tab 98 for the bias spring 82; (4) a tab 100 for a rotary trip lever 101 (FIG. 6); and (5) a latch surface 102 for a corresponding latch surface 104 (as best shown in FIG. 22) of the rotary plunger 32.

Figure 18:
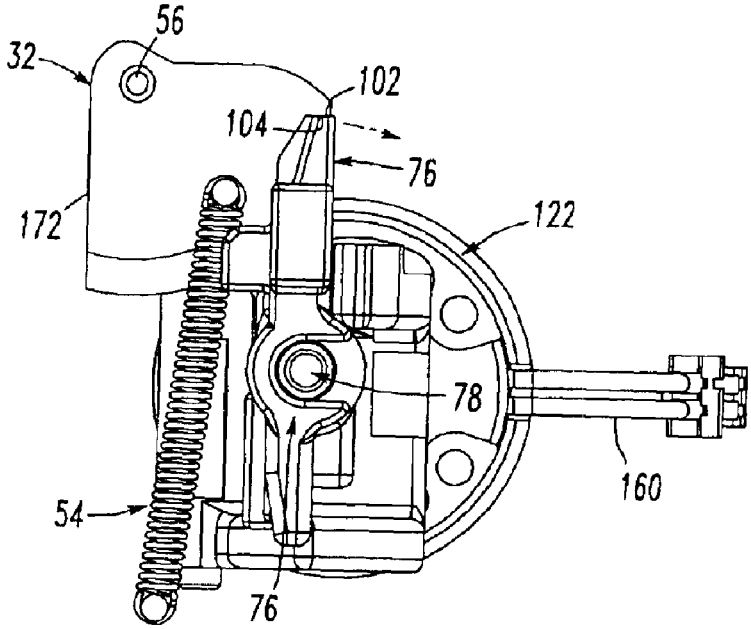
FIGS. 18, 19A–19B and 20 are isometric views of the trip actuator, rotary trip lever, trip bar, and rotary plunger and spring mechanism in the latched or on position, in the reset or overtravel position, and in the tripped position, respectively.
Figure 19B:
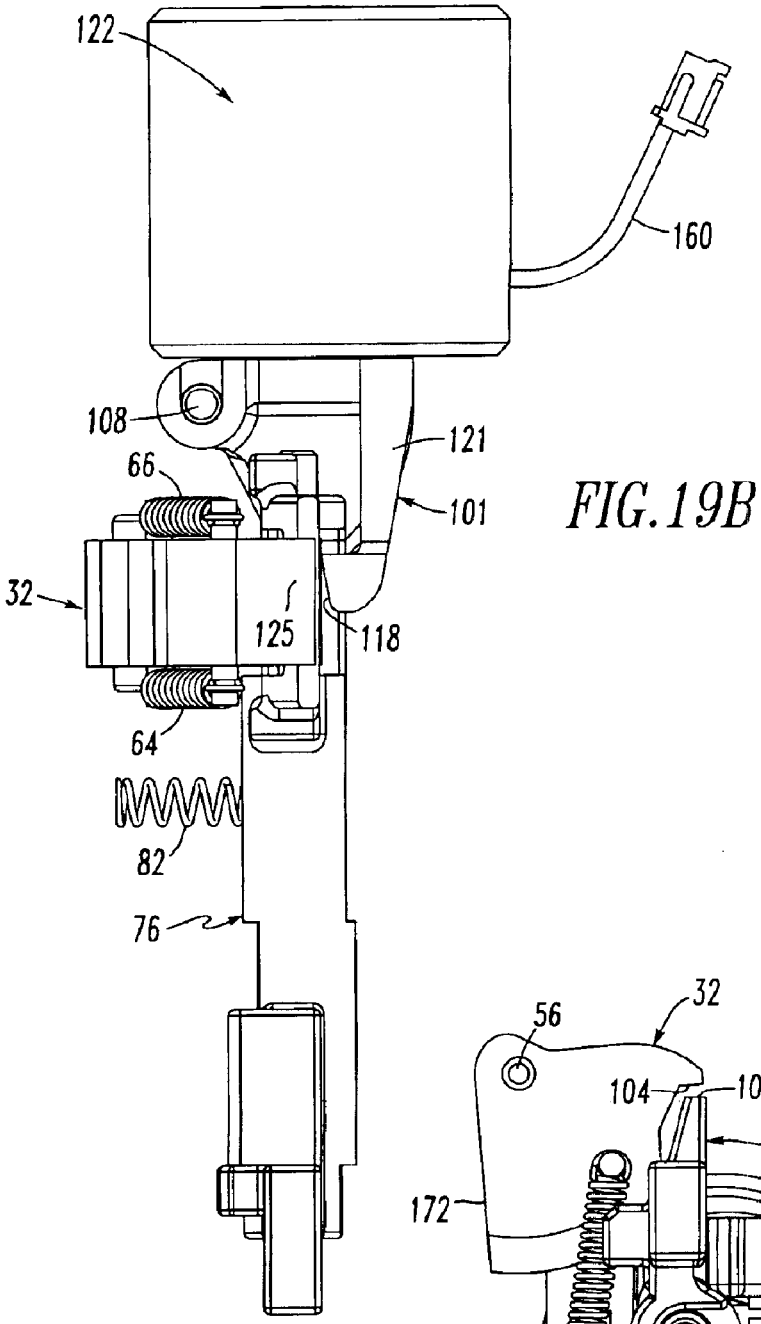
Figure 19A:
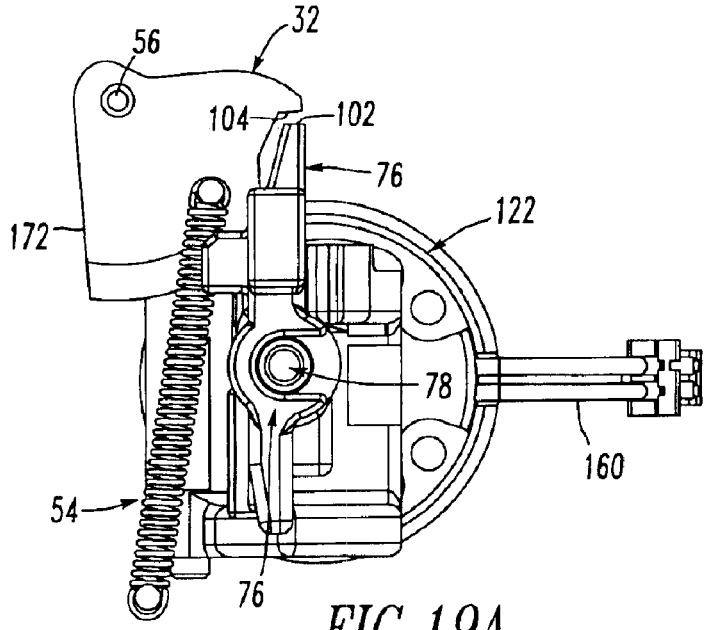

Whenever the attachment button 36 (FIG. 3) is depressed into the opening 34 of the surface 26 of the base 6 by a shunt (or remote) trip attachment (not shown) or by an under voltage release attachment (not shown), the button plunger 46 (FIG. 5) engages the tab 94 on the trip bar 76 and rotates the trip bar clockwise (with respect to FIG. 5, as viewed from the bottom left, and FIG. 18). Similarly, whenever a ground fault (e.g., equipment protection) bolt on unit (not shown) engages the earth leakage button 40 (FIG. 10) and depresses the same into the opening 38 of the cover 8, the button plunger 97 engages the trip bar tab 96 to also rotate the trip bar 76 in the same clockwise direction (with respect to FIGS. 5 and 18). The spring 82, which rests in the base opening 84, biases the trip bar 76 in the opposite rotational direction (e.g., counter-clockwise with respect to FIGS. 5 and 18). The spring 82 engages the housing base 6 and the tab 98, in order to bias that tab and, thus, the trip bar 76 with respect to the housing 12, in order that the trip bar latch surface 102 engages the corresponding internal latch surface 104 of the rotary plunger 32 (as best shown in the on position of FIG. 18). The spring 82, thus, biases the trip bar 76 to a non-actuated or on position, which holds the rotary plunger 32 and, hence, prevents the spring mechanism 54 from rotating the rotary plunger 32 to the tripped position of FIG. 20. Hence, the spring 82 biases the tab 98 and the trip bar 76 to resist rotation caused by the buttons 36,40, and the trip bar latch surface 102 engages the rotary plunger latch surface 104, in order to latch the rotary plunger 32 in the on position (FIG. 18). However, when the trip bar 76 is rotated (e.g., by one of the buttons 36,40), the latch surface 102 moves to the right in FIG. 18 and releases the latch surface 104 of the rotary plunger 32. This releases the rotary plunger 32, which is biased by the spring mechanism 54, to the tripped position (FIG. 20).

A further trip operation is provided through the trip bar tab 100. The rotary trip lever 101 (FIG. 6) includes a surface 106, which engages the tab 100, in order to rotate the trip bar 76 clockwise (with respect to FIGS. 5 and 18) and, thus, release the latch surface 102 from the rotary plunger latch surface 104, in order to release the rotary plunger from the on position (FIG. 18) to the tripped position (FIG. 20), as was discussed above.

Figure 6:
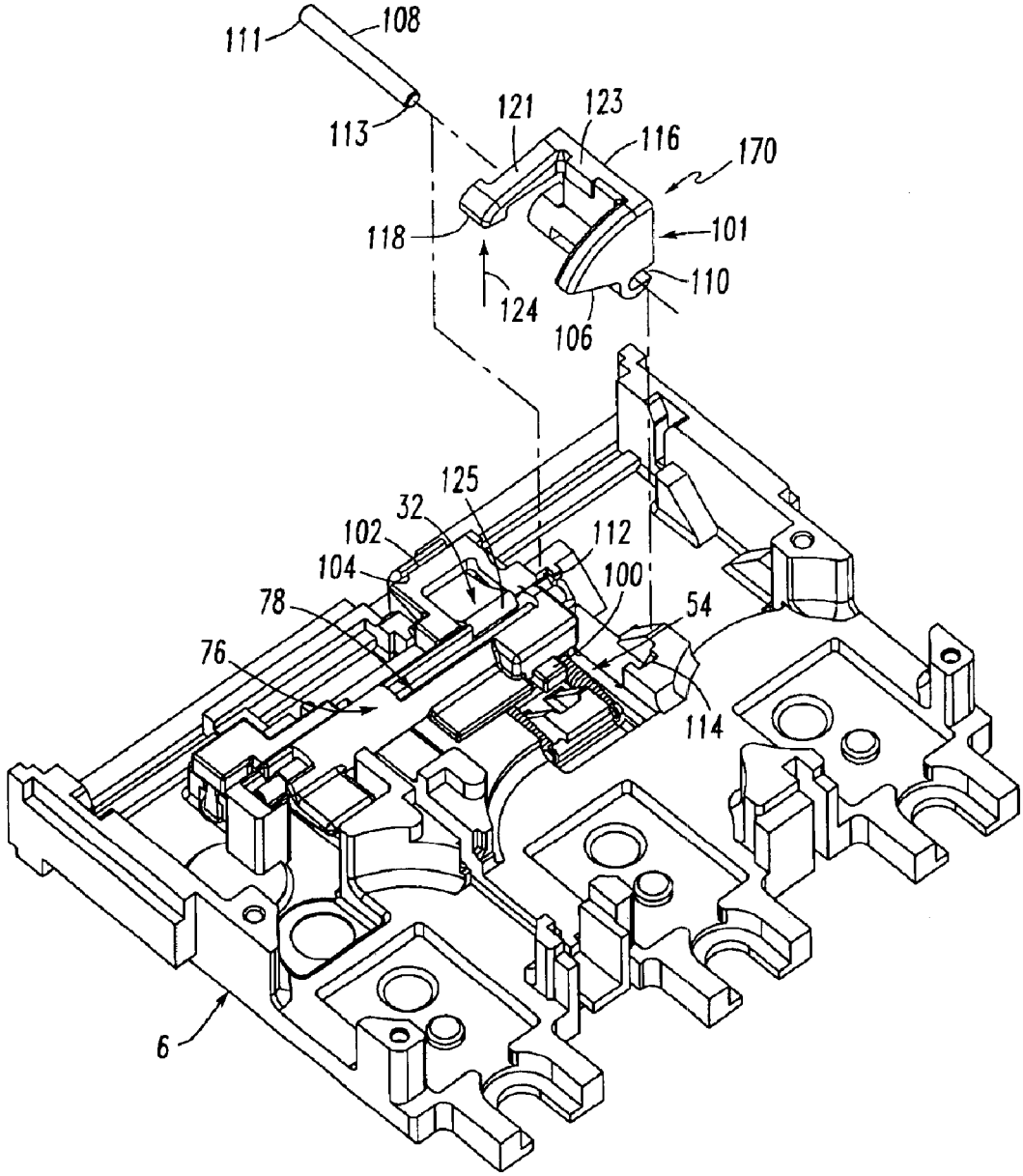
FIG. 6 is a front isometric view of the assembly of FIG. 5 with the rotary trip lever and trip lever pivot member being exploded from the base to show the assembly thereof.
Figure 17:
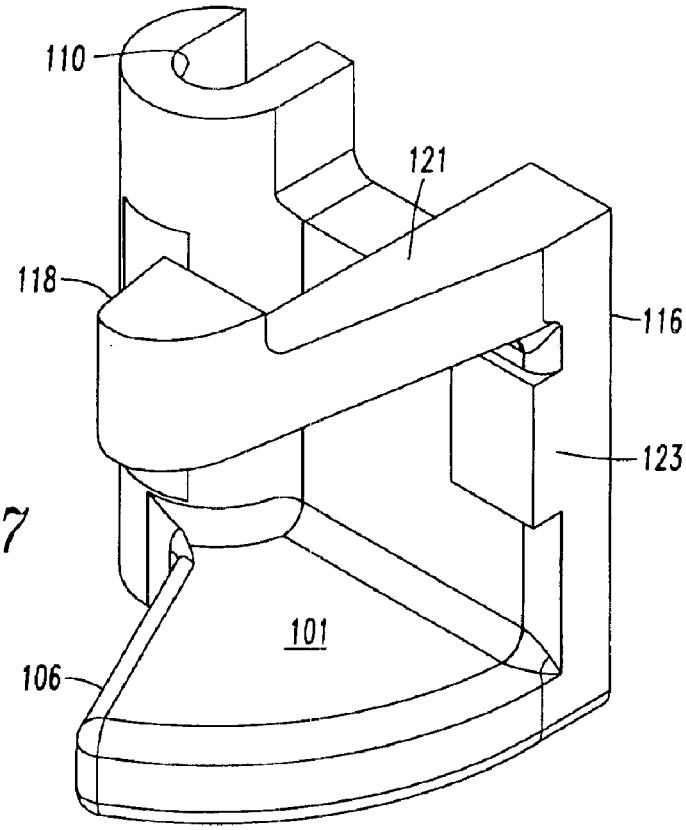
FIG. 17 is an isometric view of the rotary trip lever of FIG. 6.

FIG. 6 shows the assembly from FIG. 5 of the base 6, the spring mechanism 54, the rotary plunger 32, the trip bar 76 and the trip bar pivot member 78. The rotary trip lever 101 (as best shown in FIG. 17) and a trip lever pivot member 108 are exploded from the base 6 for ease of illustration. The pivot member 108 passes through an opening 110 in the trip lever 101. A first end 111 of the pivot member 108 rests in a first pivot point 112, and an opposite second end 113 of the pivot member 108 rests in a second pivot point 114 of the base 6, thereby pivotally mounting the rotary trip lever 101 with respect to the housing base 6 on an axis, which is normal to the pivot axis of the trip bar 76.

The rotary trip lever 101 includes three operating surfaces 116, 106 and 118. The first surface 116 is for engagement by a plunger 120 of a trip actuator, such as a flux shunt trip actuator 122 (FIG. 8) or solenoid, which causes the rotary trip lever 101 to rotate counter-clockwise (as viewed from the bottom right of FIG. 6). In turn, the second surface 106, as was discussed above, engages the tab 100 of the trip bar 76, thereby causing it to rotate clockwise (as viewed from the bottom left of FIG. 6). The trip lever 101 is preferably made of a molded material. The third surface 118 is disposed on the end of an elastic arm 121, which extends from the body 123 of the trip lever 101.

In response to a force 124, which will be described, below, from a portion, such as surface 125, of the rotary plunger 32, the rotary trip lever 101 rotates in a clockwise direction (as viewed from the bottom right of FIG. 6). This causes the first surface 116 of the trip lever 101 to engage the trip actuator plunger 120, in order to reset the trip actuator 122 in a manner to be described, below. In response to counter-clockwise (as viewed from the bottom left of FIG. 6) overtravel of the rotary plunger 32 beyond the reset position (FIGS. 19A–19B) thereof, the elastic arm 121 of the rotary trip lever 101 advantageously flexes (upward with respect to FIG. 6), after the trip actuator plunger 120 has been fully reset and, thus, resists further rotation of the rotary trip lever 101 by applying a force to its surface 116. Hence, the elastic arm 121 advantageously accommodates any overtravel of the rotary plunger 32 beyond its reset position, which might be caused, for example, by manufacturing or other tolerances in the circuit breaker frame 28 of FIG. 21.

Figure 7:
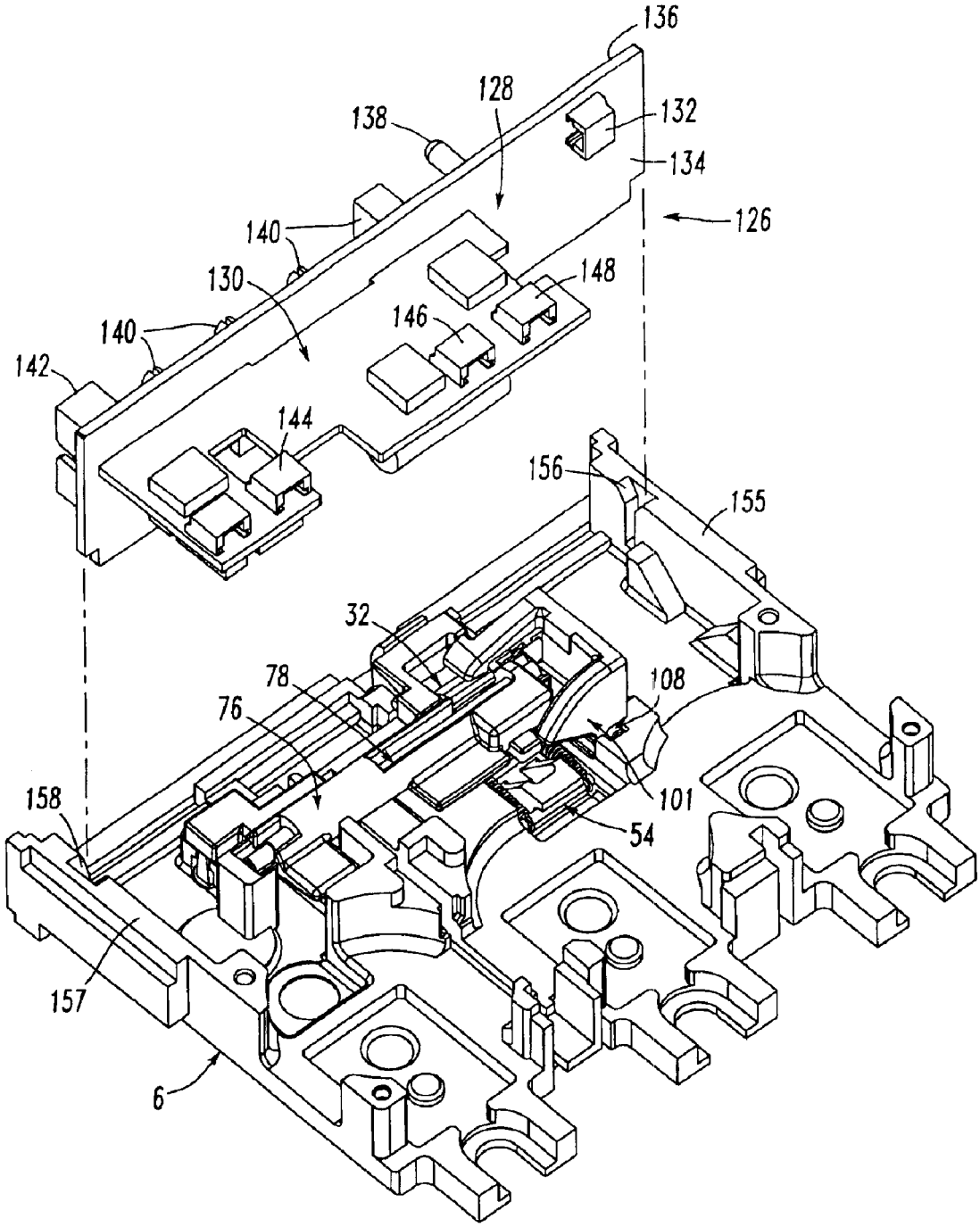
FIG. 7 is a front isometric view of the assembly of FIG. 6 with two printed circuit boards (PCBs) being exploded from the base to show the assembly thereof.
Figure 9:
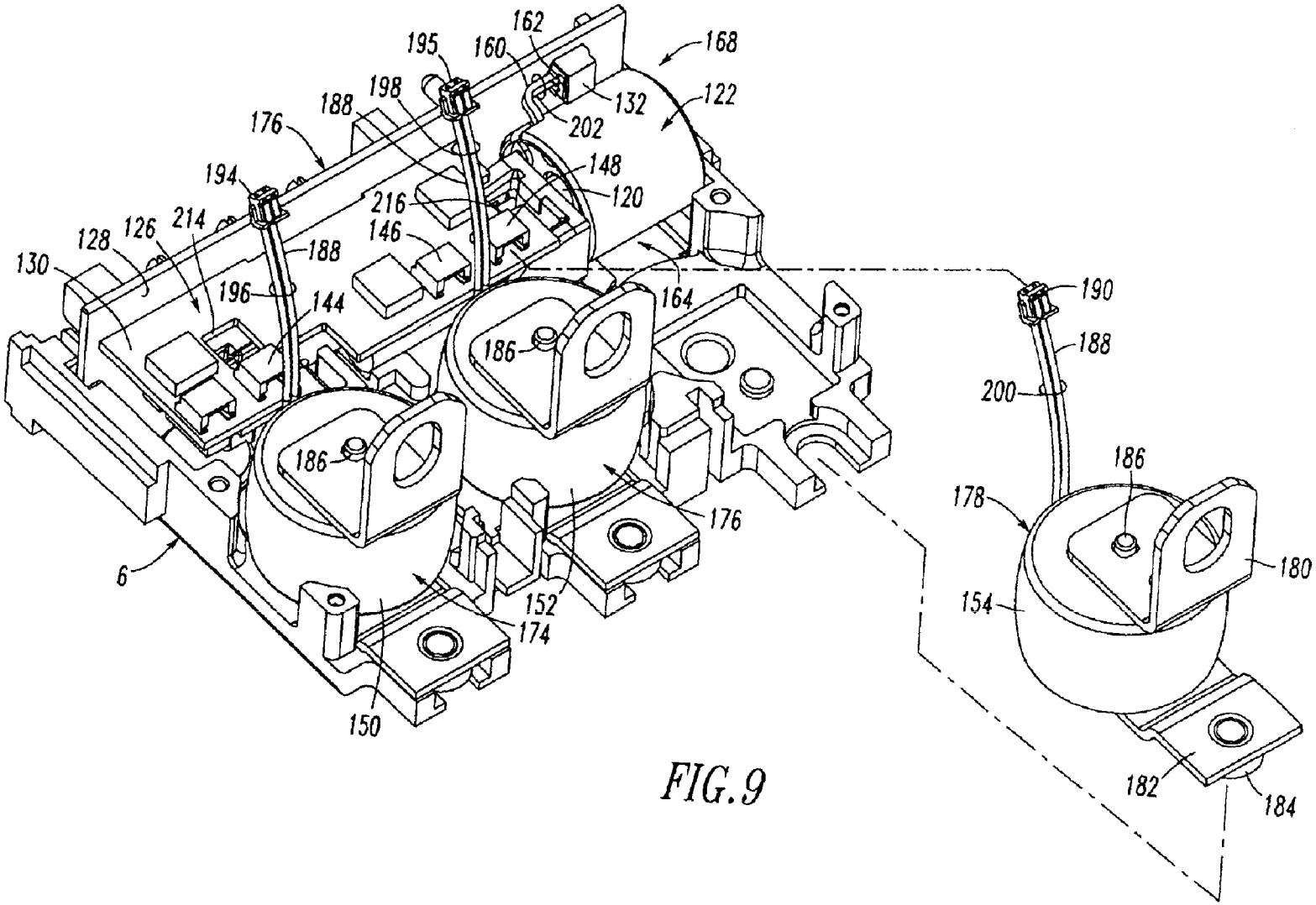
FIG. 9 is a front isometric view of the assembly of FIG. 8 including three current transformer assemblies with one of such current transformer assemblies being exploded from the base to show the assembly thereof.

Referring to FIG. 7, the assembly from FIG. 6 includes the base 6, the spring mechanism 54, the rotary plunger 32, the trip bar 76, the trip bar pivot member 78, the rotary trip lever 101 and the trip lever pivot member 108. Exploded from the base 6 for ease of illustration is a trip circuit 126 including two printed circuit boards (PCBs) 128,130, which are interconnected by suitable electrical connectors (not shown). The first PCB 128 includes a trip actuator connector 132 disposed on one side 134. The opposite side 136 includes a pair of LED indicators 138 (only one is shown), a plurality of manual controls 140 (e.g., potentiometers; rotary selectors; switches), and an interface connector 142 to a serial communication bus (not shown). The second PCB 130 includes three connectors 144,146,148 for receiving signals from three corresponding current transformers (CTs) 150,152,154 (FIG. 9). The sides 155,157 of the base 6 include slots 156,158 to receive the sides of the first PCB 128, which preferably includes a rectangular cut-out portion 159 (as partially shown in FIG. 10) to accommodate the rotary plunger 32 and the portion of the trip bar 76 at the latching surface 102 (FIG. 5).

The invention is applicable to a wide range of analog and/or digital and/or processor-based trip circuits, such as an electronic trip circuit, which is known to those skilled in the art. Examples of electronic trip circuits are disclosed in U.S. Pat. Nos. 5,428,495; and 6,167,329, which are incorporated by reference herein.

Figure 8:
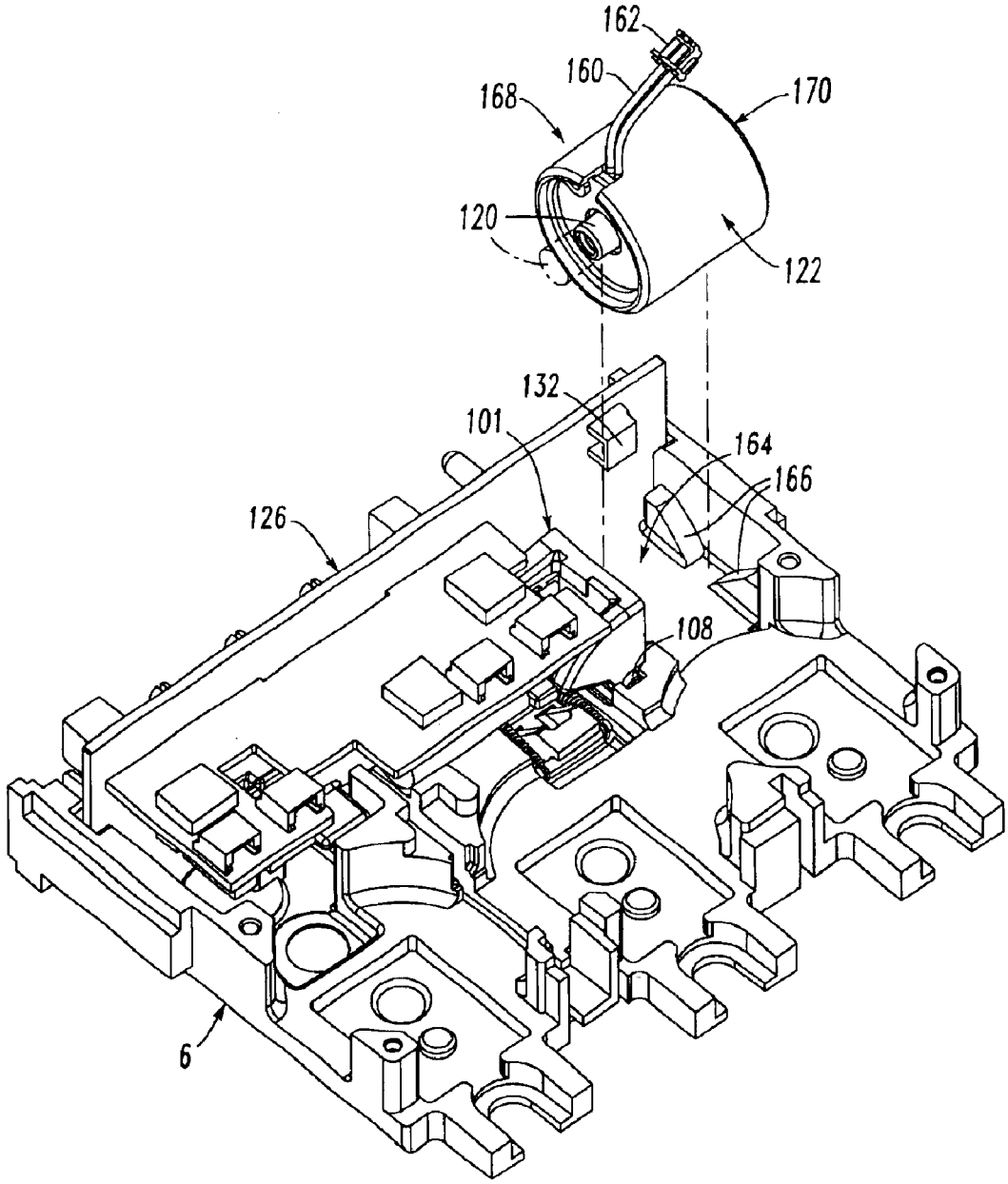
FIG. 8 is a front isometric view of the assembly of FIG. 7 with the trip actuator being exploded from the base to show the assembly thereof.

FIG. 8 shows the assembly from FIG. 7 including the base 6, the trip circuit 126, the rotary trip lever 101, and the trip lever pivot member 108, with the trip actuator 122 being exploded from the base for ease of illustration. The trip actuator 122 includes a set of wires 160 terminated by a connector 162, which mates with the connector 132 of the PCB 128 of the trip circuit 126 as shown in FIG. 9. The trip actuator 122 rests in a recess 164 in the base 6, which provides a pair of V-shaped supports 166 (only one support 166 is shown) for the opposite ends of the trip actuator. When the trip actuator 122 is energized by the trip circuit 126 through the connectors 132,162 and the wires 160, the linear plunger 120 is in an actuated or extended state (shown in phantom line drawing). The extended linear plunger 120 engages the trip lever surface 116 (FIG. 17) and rotates the rotary trip lever 101 counter-clockwise (with respect to the bottom right of FIG. 8). In turn, as was discussed above in connection with FIG. 6, the trip lever surface 106 engages the trip bar tab 100, which rotates the trip bar 76 and disengages the trip bar latch surface 102 from the rotary plunger latch surface 104, in order to release the rotary plunger 32 from the on position (FIG. 18) and trip open the operating mechanism 167 of the attached circuit breaker frame 28 of FIG. 21. The plunger 120 and the rotary trip lever 101, thus, cooperate to engage and pivot the trip bar 76.

The trip unit 2 includes a latching mechanism 168, which is formed from the combination of the trip bar 76 and the spring 82 of FIG. 5, and a trip actuator mechanism 170, which is formed from the trip actuator 122 having the plunger 120 and a trip member, such as the rotary trip lever 101. The latching mechanism 168 functions to latch the rotary plunger 32 of FIG. 5 in the on position (FIG. 18) in which a rotary plunger surface 172 (FIGS. 2 and 22) is about flush with the surface 26 of the trip unit housing 4 (FIG. 2, which shows the reset position of FIGS. 19A–19B). The latching mechanism 168 also functions to releases the rotary plunger 32 from the on position to the tripped position (FIG. 20), and to re-latch the rotary plunger 32 in the on position by employing the reset position (FIGS. 19A–19B) thereof.

Referring to FIG. 9, the assembly from FIG. 8 includes the base 6, the trip circuit 126, the latching mechanism 168 having the trip actuator 122, two current transformer assemblies 174,176, and a third current transformer assembly 178, which is exploded from the base for ease of illustration. The current transformer assemblies 174,176,178 include the current transformers 150,152,154, respectively. These assemblies also include, as shown with the assembly 178, a load side L-shaped conductor 180, a line side conductor 182 having a terminal 184 for a load end conductor 185 of the circuit breaker frame 28 of FIG. 21. The current transformer 154 of the assembly 178 has an opening (not shown) through which a copper cylindrical center conductor 186 passes. In turn, the ends of the center conductor 186 are electrically connected (e.g., through a peening operation) with the load side conductor 180 and the line side conductor 182. Disposed from the current transformer 154 are a set of wires 188 and a connector 190 therefor. The connector 190 mates with the corresponding connector 148 of the PCB 130 of the trip circuit 126. Each of the CTs 150,152 of the respective CT assemblies 174,176 is disposed about a corresponding one of the conductors 186 and includes a corresponding set of the wires 188. The CT assembly 174 includes a connector 194, which defines an output and which is connected to the connector 144 of the PCB 130 of the trip circuit 126. Similarly, the CT assembly 176 includes a connector 195, which defines an output and which is connected to the connector 146 of the PCB 130 of the trip circuit 126. The connectors 144,146,148 of the trip circuit 126 define three inputs, which are electrically connected to the outputs of the CTs 150,152,154, respectively. In turn, the trip circuit connector 132 defines an output having a trip signal 202, which is output through the connector 162 and the wires 160 to the trip actuator 122. Hence, there are three CT assemblies 174,176,178 for three phases. The PCB 130 receives three input signals 196,198,200 from the three CTs 150,152,154, respectively, and the PCB 128 outputs a control or trip signal 202 through the connectors 132,162 and the wires 160 to the trip actuator 122.

FIG. 10 shows the assembly from FIG. 9 including the base 6, the trip circuit 126, the latching mechanism 168 having the trip actuator 122, the CT assemblies 174,176,178 and the cover 8 having the earth leakage button 40 and a spring 204 therefor. As shown in hidden line drawing, the cover includes four posts 206,208 and 210,212, which correspond to the four pivot points 86,88 (as best shown in FIG. 5) and 112,114 (as best shown in FIG. 6), respectively, of the base 6. These posts and pivot points cooperate to pivotally capture the ends of the pivot members 78,108. The PCB 130 includes an opening 214 for the pivot point 86 and a cutout 216 for the pivot point 88.

When the earth leakage button 40 is depressed within the opening 38 by a ground fault (e.g., equipment protection) bolt on unit (not shown), the plunger 97 engages the tab 96 of the trip bar 76 (FIG. 5), in order to rotate such trip bar and release the rotary plunger 32 (FIG. 5) to the tripped position (FIG. 20), in the manner as was discussed above. The spring 204, which rests between an internal surface (not shown) of the cover 8 and a surface 218 of the button 40, biases the button plunger 97 away from the trip bar tab 76. The button 40 includes two opposing feet 220 of two legs 221 (only one foot 220 and one leg 221 are shown in FIG. 10). The feet 220 extend in opposite directions (left and right with respect to FIG. 10) and protrude through and are captured by the cover opening 38.

As can be seen from FIG. 10, the trip unit 2 of FIGS. 1 and 2 integrates the flux shunt trip actuator 122, the rotary trip lever 101, the trip bar 76 (FIG. 5), the electronic trip circuit 126 and the current transformer assemblies 174,176, 178 into the molded case trip unit housing 4 for the molded case circuit breaker 179 of FIG. 21. It is believed that the number and complexity of parts is less than in known prior art trip units. The mechanical trip bar 76 interfaces directly with the rotary trip lever 101 and rotary plunger 32, thereby providing a very compact tripping system that provides a reliable and repeatable tripping force through such rotary plunger. In summary, the miniaturized combination of the flux shunt trip actuator 122, the rotary trip lever 101, the trip bar 76 and the rotary plunger 32 in combination with the trip circuit 126 allow the trip unit 2 to be relatively very compact, yet have relatively high reliability and relatively low cost.

Figure 12:
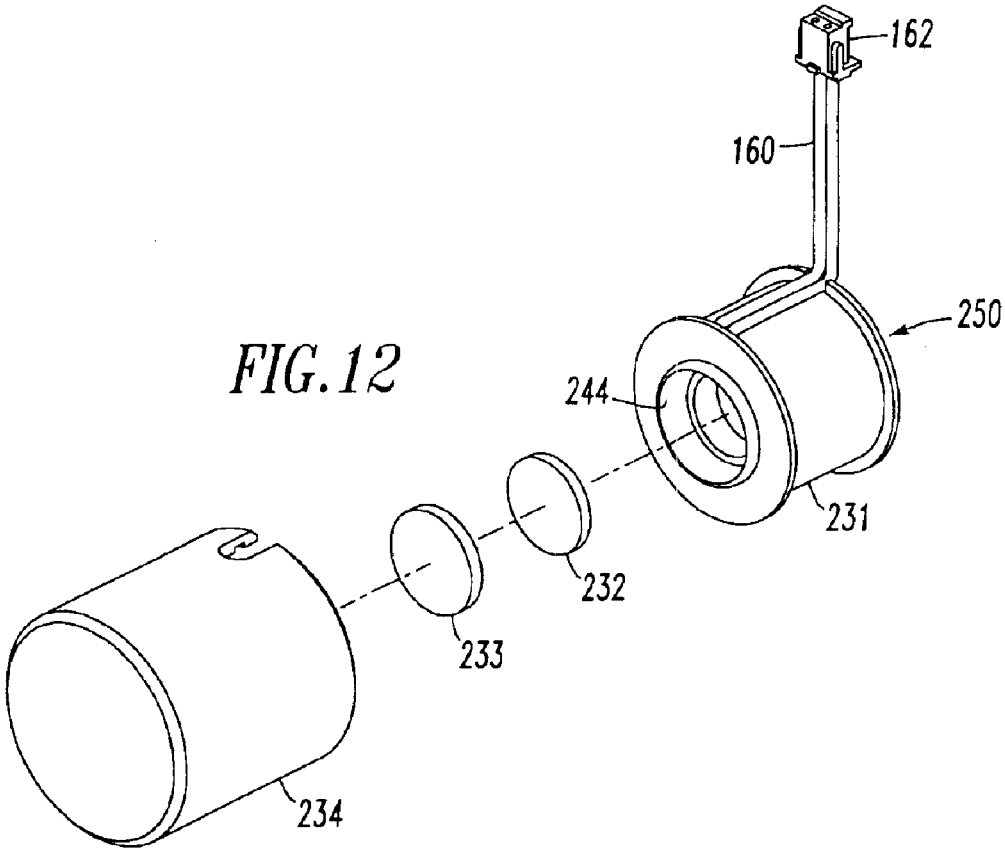
FIGS. 12–14 are exploded isometric views showing the assembly of the trip actuator of FIG. 11.
Figure 13:
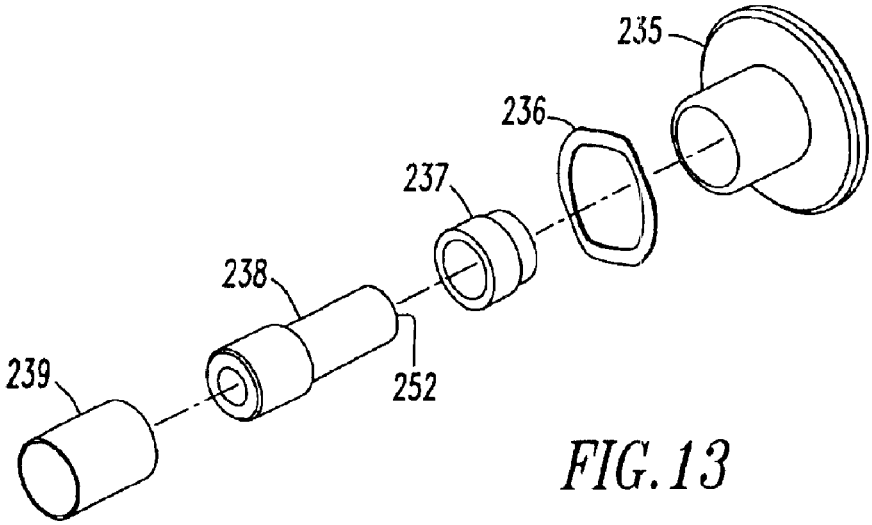
Figure 14:
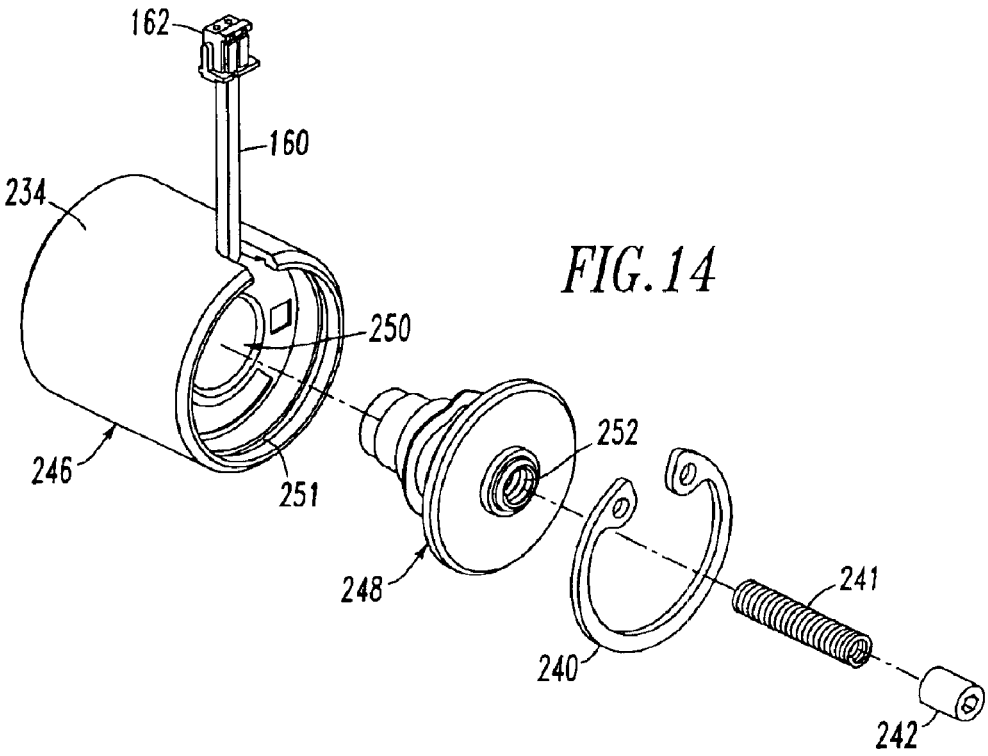

Referring to FIGS. 11–14, the trip actuator 122 includes a bobbin assembly 231 having the wires 160 and the connector 162, a disk spacer 232, a disc magnet 233, which is preferably magnetized after the assembly steps of FIGS. 12–14, a housing 234, a cover 235, a wave washer 236, an upper bushing 237, an armature or plunger 238, a lower bushing 239, an internal retaining ring 240, a spring 241 and a set screw 242.

As shown in FIG. 12, the disk spacer 232 is inserted into a recess 244 of the bobbin assembly 231 followed by the non-magnetized magnet 233, which is preferably magnetized after the assembly steps of FIGS. 12–14, in order to provide a more uniform and consistent magnetic field strength, to provide more predictable tripping without subsequent manufacturing adjustment, and to facilitate the convenient assembly of the non-magnetized magnet 233. For example, a suitable magnetizer (not shown), such as a Model 7500/900-6i marketed by Magnetic Instruments of Indianapolis, Ind., may be employed to magnetize the non-magnetized magnet 233 within the assembly of the final trip actuator 122 (as shown in FIG. 8). The bobbin assembly 231, the spacer 232, the magnet 233 and the housing 234 form the sub-assembly 246 of FIG. 14.

FIG. 13 shows the assembly of the cover 235, the wave washer 236, the upper bushing 237, the armature or plunger 238 and the lower bushing 239. This forms the sub-assembly 248 of FIG. 14.

FIG. 14 shows the assembly of the sub-assemblies 246, 248 along with the internal retaining ring 240, the spring 241 and the set screw 242. First, the sub-assembly 248 is inserted into the recess 250 of the sub-assembly 246. Then, the internal retaining ring 240 is employed to hold the sub-assembly 248 within the sub-assembly recess 250 by engaging the rim 251 of the sub-assembly 246. The spring 241 passes through the sub-assembly 248 and extends from the disk spacer 232 (FIG. 12) to the set screw 242, which threadably engages the end 252 (FIGS. 13 and 14) of the plunger 238.

When the bobbin assembly 231 is energized through the wires 160 by the PCB 128 of FIG. 9 in response to a detected trip condition, the resulting repelling magnetic force on the armature 238 sufficiently overcomes the attracting magnetic force of the magnetized magnet 233, in order that the spring 241 biases the set screw 242 and, thus, the plunger 238 away from the trip actuator housing 234 (to the position of the plunger 120 shown in phantom line drawing in FIG. 8). In turn, the plunger 120 engages the rotary trip lever surface 116 (FIG. 6). Then, the rotary trip lever surface 106 engages the tab 100 of the trip bar 76, which rotates and releases the rotary plunger 32, which trips open the circuit breaker frame 28 of FIG. 21. With the plunger 238 extended, the bias of the spring 241 is sufficient to overcome the reduced attracting magnetic force of the magnet 233 on the armature 238, which is now sufficiently separated therefrom. However, in response to the reset operation (as shown in FIGS. 19A–19B), whenever the rotary trip lever 101 (FIG. 6) moves the trip actuator plunger 238 sufficiently close to the magnet 233, the increased attracting magnetic force of such magnet, which is now sufficiently close to the armature 238, is sufficient to overcome the bias of the spring 241, thereby magnetically holding the plunger 238 within the housing 234. Otherwise, when the bobbin assembly 231 is not energized, but has been reset by the rotary plunger 32 and the rotary trip lever 101, the magnet 233 holds the armature 238 in the non-actuated, non-extended state (as shown by the plunger 120 in FIG. 8).

A member, the rotary trip lever 101 (FIG. 6), includes a first or on position corresponding to the on position (FIG. 18) of the rotary plunger 32, a second or tripped position (FIG. 20), and a third or reset position (FIGS. 19A–19B), which resets the trip actuator 122. In the first position, the surface 106 is offset from the trip bar tab 100. In the second position, the plunger 120 engages the surface 116 and the surface 106 engages the tab 100, in order to rotate the trip bar 76. In the third position, the rotary plunger surface 125 engages the surface 118 and the surface 116 engages the plunger 120, in order to reset the trip actuator 122.

Similarly, a member, such as the linear plunger 120 of FIG. 8 includes a first or non-actuated position (FIG. 8) corresponding to the on position (FIG. 18) of the rotary plunger 32, a second or actuated position (as shown in phantom line drawing in FIG. 8), and a third or reset position (between the actuated and non-actuated positions), which resets the trip actuator 122 as the armature 238 is attracted by the magnet 233. The plunger actuated position engages the surface 116 and rotates the rotary trip lever 101 in response to the output control or trip signal 202 of the trip circuit 126, in order to engage the trip bar 76 with the surface 106 (FIG. 6) and release the rotary plunger 32 from the on position (FIG. 18). Following the trip position (FIG. 20) and during a reset operation (FIGS. 19A–19B), the rotary plunger surface 125 engages the trip lever surface 118 (FIG. 6) at about the reset position of the rotary plunger 32 and rotates the rotary trip lever 101, in order to engage the trip lever surface 116 with the trip actuator plunger 120 and move that member to the reset position thereof. As was discussed above, the rotary trip lever elastic arm 121 flexes after the trip actuator plunger 120 reaches or passes the reset position thereof, in order to accommodate any overtravel of the rotary plunger 32 beyond its reset position (FIGS. 19A–19B).

Referring to FIGS. 15 and 22, the external surface 172 of the rotary plunger 32 is pivoted outside of the housing 4 (FIG. 2) through the opening 30 thereof in the tripped position (FIG. 20). The surface 172 is adapted to engage a latch mechanism 253 of the circuit breaker frame 28 of FIG. 21. In this example, as shown by the rotary plunger portion 74 as defined by the phantom line in FIG. 22, the portion 74 is generally pie-slice shaped, with a first sub-portion 254 having a first radius and a second sub-portion 256 having a smaller second radius. The smaller second sub-portion 256 is adapted to provide clearance from other components of the circuit breaker frame 28.

During operation and, in particular, tripping operation of the circuit breaker frame 28 of FIG. 21, the trip unit housing opening 30 may include debris (not shown) from such circuit breaker frame. Then, when the rotary plunger portion 74 is pivoted outside of the trip unit housing 4, the rotary plunger 32 advantageously sweeps the debris out of the opening 30.

FIG. 18 (latched or on position), FIGS. 19A–19B (reset or overtravel position) and FIG. 20 (tripped position), show the three operating positions of the rotary plunger 32 with respect to the trip actuator 122, the rotary trip lever 101 (as shown in FIG. 19B), the trip bar 76 and the spring mechanism 54. As shown in FIG. 18, the trip bar latch surface 102 engages and holds the rotary plunger latch surface 104, in order to latch the rotary plunger 32 in the on position thereof. This on position, in which the rotary plunger surface 172 is preferably flush with, about flush with or substantially flush to the housing surface 26 (FIG. 2), is intermediate the external tripped position of FIG. 20 and the internal reset position of FIGS. 19A–19B.

In the tripped position of FIG. 20, the rotary plunger 32 trips the circuit breaker 179 of FIG. 21 by rotating the latch 332 (clockwise with respect to FIG. 21) as the rotary plunger 32 rotates (clockwise with respect to FIGS. 18 and 20) from the latched position of FIG. 18 to the tripped position of FIG. 20. In response to rotation (clockwise with respect to FIGS. 18 and 20) of the trip bar 76 against the bias of its spring 82 (FIG. 5) resulting from the earth leakage button 40 (FIG. 10), the attachment button 36 (FIG. 3) or the rotary trip lever 101 (FIG. 6), this rotation releases the trip bar latch surface 102 from the rotary plunger latch surface 104. In turn, the rotary plunger 32 rotates outward as shown in FIG. 20, with its surface 172 being pivoted external to the housing 4 of FIG. 2, in order to trip open the circuit breaker 179.

As shown in FIGS. 20 and 22, the rotary plunger 32 includes a cam surface 258, which engages a surface 260 (extending downward in FIG. 5) near the latching surface 102 of the trip bar 76 (FIG. 5). As the rotary plunger 32 rotates toward the reset position (FIGS. 19A–19B), the trip bar tab 262, which forms the surfaces 102,260, engages the rotary plunger cam surface 258. Then, at about the reset position (FIGS. 19A–19B), the cam surface 258 releases the tab 262 and the trip bar 76 rotates (counterclockwise with respect to the bottom left of FIG. 5) under the bias of the spring 82. Hence, the trip bar latching surface 102 rotates toward the left of FIGS. 18 and 20 in preparation to engage the rotary plunger latching surface 104 in the on position of FIG. 18.

In the reset position of FIGS. 19A–19B, the rotary plunger 32 resets both: (1) the trip bar 76; and (2) the solenoid trip actuator device 122 through the rotary trip lever 101. When the operating mechanism 167 of the attached circuit breaker frame 28 of FIG. 21 is reset, the rotary plunger 32 is driven by the latch 332 to the internal, non-extended reset position (FIGS. 19A–19B). A single motion of the rotary plunger 32 (FIGS. 19A–19B) is used to: (a) reset the trip actuator 122 through the rotary trip lever 101, and (b) reset the trip mechanism components (e.g., the trip bar 76, since the rotary trip lever 101 is reset). The trip bar latch surface 102 re-engages the rotary plunger latch surface 104 as the rotary plunger 32 rotates from the external tripped position (FIG. 20) to the internal reset position (FIGS. 19A–19B) thereof. As the rotary plunger 32 pivots from the external tripped position to the internal reset position thereof, the rotary plunger surface 125 rotates the trip lever 101 (as shown in FIG. 19B), in order to reset the trip actuator 122 through its plunger 120 (FIG. 8). Any overtravel of the rotary plunger 32 flexes the rotary trip lever elastic arm 121.

After a trip, the trip actuator 122 is no longer energized; however, the trip actuator spring 241 (FIGS. 11 and 14) causes the solenoid armature or plunger 238 to remain extended, thereby preventing the trip bar 76 from returning to the latched or on position (FIG. 18) under the bias of its spring 82 (FIG. 5). For a reset operation (FIGS. 19A–19B), the rotary plunger 32 rotates the rotary trip lever 101, through its resilient arm 121, in order to cause the trip actuator 122 to be reset to the position where the armature or plunger 238 is held in place by the magnet 233 thereof. At the same time, the trip bar spring 82 causes the trip bar 76 to rotate (counterclockwise with respect to FIGS. 19A–19B) back to its latching position (FIG. 18), in order to hold the rotary plunger 32 in the latched or on position of FIG. 18.

FIG. 21 shows the molded case circuit breaker 179 including the circuit breaker frame 28 and the removable trip unit 2 of FIG. 1. Examples of circuit breakers and circuit breaker frames are disclosed in U.S. Pat. Nos. 5,910,760; 6,137,386; and 6,144,271, which are incorporated by reference herein. The example breaker or interrupter 179 includes a main base 300 and primary cover 302 attached to a secondary cover 304. The base 300 and covers 302,304 form a housing 305. A handle 306 extends through a secondary escutcheon 308 in the secondary cover 304 and an aligned primary escutcheon 310 in the primary cover 302. The operating mechanism 167 is interconnected with the handle 306 and assists in opening and closing separable main contacts 312 as is well known. The circuit breaker 179 has a line end 314 including a plurality of line terminals 315, 316,317, a load end 316 including a plurality of load terminals 318,319,320, a right side accessory region or pocket 322 and a left side accessory pocket or region 324. The separable contacts 312 are electrically connected between the line terminals 315,316,317 and a plurality of load end terminals 325,326,327.

The load end terminals 325,326,327 of the circuit breaker frame 28 are electrically connected to the line end terminals

14,16,18 (as best shown in FIGS. 1 and 2) of the trip unit 2 by a plurality of conductors 328,329,330, respectively. In turn, the corresponding load end terminals 20,22,24 (FIG. 1) of the trip unit 2 are electrically connected the corresponding line end terminals 14,16,18, respectively, by the conductors 186 (FIG. 9). Those load end terminals 20,22,24 are also electrically connected by suitable user installed terminations (not shown) to the load terminals 318,319,320, respectively, of the circuit breaker frame 28.

The latch mechanism 253 latches the operating mechanism 167 to provide the closed position of the separable contacts 312 and releases such operating mechanism to provide the open position of such separable contacts. The latch mechanism 253 includes a primary frame latch (not shown), which operates or rotates on a primary frame latch pivot (not shown). The primary frame latch cooperates with the secondary frame latch 332, which rotates on a secondary frame latch pivot 334. Actuation of the latch mechanism 253 occurs exclusively by way of the utilization of the resetable trip unit rotary plunger 32 (FIGS. 4, 15 and 22), which is normally contained entirely within the removable trip unit 2. In particular, the pivotable secondary frame latch 332 is in disposition to be pivoted by the rotary plunger surface 172 through the rotation of rotary plunger 32.

When the trip unit 2 is disengaged (not shown) from the circuit breaker frame 28, a surface 336 thereof cams the rotary plunger surface 172 (FIG. 20) to pivot the rotary plunger 32 (counter-clockwise with respect to FIG. 20) to be about flush with the trip unit housing surface 26.

In the tripped position of the rotary plunger 32, its rotating action (clockwise with respect to FIG. 20) sweeps debris out of the way in the opening 30 of the trip unit 2. Also, the rotary plunger 32 moves out of the way (counter-clockwise with respect to FIGS. 18 and 20) for ease of removal of the trip unit 2 from the circuit breaker frame 28, even in the tripped position thereof.

The rotary plunger design provides more travel in order to reliably trip open the circuit breaker frame 28. After being tripped, when the trip unit 2 is removed from the circuit breaker frame 28, the frame surface 336 engages the rotary plunger 32 and rotates it toward the on position, thereby permitting removal of the trip unit 2 from the frame 28.

The user may push in and latch the rotary plunger 32 in the on position thereof prior to insertion of the trip unit 2 in the circuit breaker frame 28.

Although not required, the rotary plunger 32 may have two levels 254,256 (FIG. 22) in order to provide clearances with the circuit breaker frame components.

The rotary plunger 32 sweeps debris by rotating and, thus, by providing a sweeping action.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A trip unit comprising:

a housing;

a rotary plunger pivotally mounted with respect to said housing, said rotary plunger having a first position and a second position, a portion of said rotary plunger being pivoted outside of said housing in said second position;

a trip bar pivotally mounted with respect to said housing, said trip bar including a first tab latching said rotary plunger in said first position and releasing said rotary plunger from said first position, said trip bar also including a second tab;

a trip actuator including a member engaging the second tab of said trip bar, in order to pivot said trip bar and release said rotary plunger from said first position;

means for biasing said trip bar, in order that said first tab latches said rotary plunger in said first position; and means for biasing said rotary lunger to said second position.

2. The trip unit of claim 1 wherein said trip actuator further includes a solenoid having a linear plunger; wherein the member of said trip actuator is a trip lever pivotally mounted with respect to said housing, said linear plunger engaging and pivoting said trip lever, in order to engage the second tab of said trip bar, pivot said trip bar and release said rotary plunger from said first position.

3. The trip unit of claim 1 wherein said trip bar further includes a third tab; and wherein said means for biasing said trip bar is a spring engaging said housing and the third tab of said trip bar, in order that said first tab latches said rotary plunger in said first position.

4. The trip unit of claim 1 wherein said rotary plunger includes a first pivot engaging said housing; and wherein said means for biasing said rotary plunger to said second position includes a member engaging said housing at a position offset from said first pivot, a second pivot engaging said rotary plunger at a position offset from said first pivot, a first spring and a second spring, said member and said second pivot including a first end and a second end, said first spring engaging the first ends of said second pivot and said member, and said second spring engaging the second ends of said second pivot and said member.

5. A trip unit comprising:

a housing;

a rotary plunger pivotally mounted with respect to said housing, said rotary plunger having a first position and a second position, a portion of said rotary plunger being pivoted outside of said housing in said second position;

means for latching said rotary plunger in said first position and for releasing said rotary plunger from said first position;

wherein said rotary plunger includes a latch surface within said housing; and wherein said trip bar includes a tab engaging the latch surface of said rotary plunger, in order to latch said rotary plunger in said first position; and wherein the tab of said trip bar is a first tab; wherein said trip bar includes a second tab; wherein said means for latching said rotary plunger in said first position and for releasing said rotary plunger from said first position further includes a rotary trip lever pivotally mounted within said housing, said rotary trip lever engaging the second tab of said trip bar, in order to rotate said trip bar and disengage the first tab from the latch surface of said rotary plunger, in order to release said rotary plunger from said first position.

6. The trip unit of claim 5 wherein said means for latching said rotary plunger in said first position and for releasing said rotary plunger from said first position further includes a trip actuator having a linear plunger engaging said rotary trip lever, in order to rotate said rotary trip lever to engage the second tab of said trip bar.

* * * * *